US007244916B2

(12) United States Patent
Iwamoto

(10) Patent No.: US 7,244,916 B2
(45) Date of Patent: Jul. 17, 2007

(54) MICROWAVE HEATING AND COOKING APPARATUS INCLUDING DRAWER BODY

(75) Inventor: Masayuki Iwamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/028,849

(22) Filed: Jan. 4, 2005

(65) Prior Publication Data

US 2005/0173426 A1 Aug. 11, 2005

(30) Foreign Application Priority Data

Jan. 14, 2004 (JP) ..... 2004-007385
Jul. 23, 2004 (JP) ..... 2004-216334

(51) Int. Cl.
*H05B 6/64* (2006.01)

(52) U.S. Cl. ..... 219/756; 219/763; 219/403; 126/340

(58) Field of Classification Search ..... 219/756, 219/752, 753, 754, 739, 385, 521; 432/239, 432/121, 153; 414/147, 150, 153
See application file for complete search history.

(56) References Cited

U.S. PATENT DOCUMENTS 4,335,292 A * 6/1982 Tanaka et al. ..... 219/754
5,345,068 A * 9/1994 Hatano et al. ..... 219/722
6,166,353 A 12/2000 Senneville et al.
6,858,825 B1 * 2/2005 Ruffa ..... 219/706

FOREIGN PATENT DOCUMENTS

EP 0521-251 * 1/1993
EP 521251 A1 * 1/1993
JP 51-114748 10/1976
JP 55-169918 5/1980
JP 56-110827 9/1981
JP 03-045820 2/1991
JP 03-45821 2/1991
JP 03-45822 2/1991

(Continued)

OTHER PUBLICATIONS

Japanese Office Action for corresponding Application No. 2004-216334 dated Dec. 12, 2006.

(Continued)

*Primary Examiner*—Quang Van
(74) *Attorney, Agent, or Firm*—Renner, Otto, Boisselle & Sklar, LLP

(57) ABSTRACT

A heating and cooking apparatus includes a cooking apparatus main body having a heating chamber, a drawer body including a base for carrying a heated target and formed such that the base moves from inside of the heating chamber to outside, a door drive motor moving the drawer body, and a control unit controlling the door drive motor for varying a moving speed of the door. The control unit is formed to control the door drive motor such that a moving speed of the drawer body at at least one stage selected from a group consisting of a draw-out initial stage, a draw-out final stage, a push-in initial stage, and a push-in final stage is relatively slower than a moving speed of the drawer body in an intermediate stage of a draw-out and push-in operation.

13 Claims, 16 Drawing Sheets

FOREIGN PATENT DOCUMENTS

| | | | |
|---|---|---|---|
| JP | 03-31208 | | 3/1991 |
| JP | 06-109257 | | 4/1994 |
| JP | 07-158864 | | 6/1995 |
| JP | 08-261479 | | 10/1996 |
| JP | 10-205771 | | 8/1998 |
| JP | 11-008057 | | 1/1999 |
| JP | 11-166358 | | 6/1999 |
| JP | 11-237053 | | 8/1999 |
| JP | 2000-249349 | | 9/2000 |
| JP | 2003042457 A | * | 2/2003 |
| JP | 2003-253958 | | 9/2003 |
| JP | 2003-278445 | | 10/2003 |

OTHER PUBLICATIONS

Japanese Office Action for corresponding Application No. 2004-007385 dated Dec. 26, 2006.

Japanese Office Action for corresponding Application No. 2004-007385 dated Mar. 23, 2007 (with English translation).

Japanese Office Action for corresponding Application No. 2004-216334 dated Mar. 7, 2007 (with English translation).

* cited by examiner

MICROWAVE HEATING AND COOKING APPARATUS INCLUDING DRAWER BODY

This nonprovisional application is based on Japanese Patent Applications Nos. 2004-007385,and 2004-216334 filed with the Japan Patent Office on Jan. 14, 2004 and Jul. 23, 2004, respectively, the entire contents of which are hereby incorporated by reference.

1. Field of the Invention

The present invention generally relates to a heating and cooking apparatus such as a microwave oven and an oven, and more particularly to a heating and cooking apparatus for preventing an accident such as burn.

In addition, the present invention relates to a drawer type heating and cooking apparatus in which a heating container can be drawn out in a forward direction from a cooking apparatus main body.

2. Description of the Background Art

Burn represents one risk in using a heating and cooking apparatus. In a microwave oven widely used in a household as a heating and cooking apparatus, followings are examples of burn.

1) Burn from a Heated Target Heated to a High Temperature Through High-frequency Heating For example, when a food product is heated while covered with a plastic wrap, the food product covered with the plastic wrap is heated to a high temperature and a large amount of steam is produced. When the plastic wrap is removed after heating, the steam may blow out toward hands of a user and may cause burn.

The same phenomenon as above also occurs in the following case. Specifically, the food product is heated without being covered with the plastic wrap and the door is opened. Then, steam at a high-temperature is blown microwave oven in a forward direction.

2) Burn Cased by Bumping

When a liquid is heated, the liquid sometimes boils abruptly after a superheated state at a temperature higher than a boiling point is attained. Such a phenomenon is referred to as "bumping". More specifically, a "bumping phenomenon" is such that a cup of coffee does not boil even after its temperature reaches the boiling point in a heating chamber (space) through high-frequency heating, whereas it blows out at a burst by an impact when a door is opened or the cup is taken out. If such a phenomenon occurs and the steam blows toward the hands of the user, the user may suffer from burn. That is, burn by bumping represents risk less predictable than risk mentioned in 1).

In order to inform the user of such a risk, an operation manual or the like includes information on the risk of overheating, or the heating and cooking apparatus itself attains a function to inform the user of the risk when heating is finished.

For example, Japanese Patent Laying-Open No. 07-158864 proposes a heating and cooking apparatus in which even if a temperature of a door of the heating and cooking apparatus is raised through cooking, burn is prevented by appealing to vision of a user through color change.

Japanese Patent Laying-Open No. 08-261479 proposes a cooking apparatus in which an accident such as burn is prevented by informing a user that a wall surface of a heating chamber is heated to a temperature higher than a temperature that may cause burn.

Japanese Patent Laying-Open No. 10-205771 proposes a microwave oven with a heater, including an alarm for warning the user that a surface temperature of the heater has attained a temperature that may cause burn if the surface of the heater comes in contact with a human body.

Japanese Patent Laying-Open No. 2000-249349 proposes a heating and cooking apparatus automatically opening and closing a door after a safe temperature and humidity has been attained.

A door opening/closing device of a cooking apparatus proposed in Japanese Patent Laying-Open No. 03-045820 includes an apparatus main body including a cooking chamber accommodating a product to be cooked, a door shielding the cooking chamber from atmosphere, a bottom plate operating together with the door, a slide mechanism smoothly sliding the bottom plate, a motor driving the bottom plate, transmission means for transmitting driving force of the motor to the bottom plate, a latch device holding the door in the closing state, a door opening/closing switch, and a control circuit controlling the motor so as to open and/or close the door upon receiving a signal from the door opening/closing switch.

Japanese Patent Laying-Open No. 11-008057 discloses one example of a high-frequency heating apparatus including a rotational antenna.

In a conventional high-frequency heating apparatus such as a microwave oven disclosed in Japanese Patent Laying-Open Nos. 08-261479 and 10-205771, in order to reduce unevenness in heating of a food product, it is common to place the food product on a turntable for heating the same. That is, in spite of uneven heating strength caused in the heating chamber, overall unevenness in heating is reduced by the fact that the food product moves while it is turned and passes a strongly heated portion and a weakly heated portion.

On the other hand, it is said that the bumping phenomenon is caused as follows. The superheated state refers to a state in which when the liquid is heated in a still state, the liquid does not boil even after a temperature thereof reaches the boiling point. Basically, when the liquid is heated to the boiling point, the liquid should be vaporized and turned to steam. In the superheated state, however, a portion of water to be blown is held in the liquid, which state is extremely unstable. Therefore, if an impact such as vibration is applied to the liquid, the steam is blown at a burst. Such a phenomenon is called bumping.

In the conventional high-frequency heating apparatus, the food product is heated while it is turned, as described above. Therefore, slight vibration caused by turning is constantly applied to the food product. As a result, in the conventional microwave oven, possibility of the bumping phenomenon, that is, the phenomenon in which the steam blows out at a burst due to an impact when the door is opened or the food taken out, has been low.

Recently, rather than the conventional high-frequency heating apparatus employing a turntable, a high-frequency heating apparatus such as a rotational antenna type microwave oven as disclosed in Japanese Patent Laying-Open No. 11-008057 has widely been adopted for use in a household. As shown in the publication above, in the high-frequency heating apparatus of this type, a high frequency guided by a waveguide to the outside of the heating chamber passes through a hole of a small diameter provided in a wall surface of the heating chamber, and the high frequency is emitted from a bottom portion of the heating chamber by a rotational antenna consisting of a reception antenna portion and an emission antenna portion. The food product as a heated target is carried on a substantially rectangular fixed base made of a dielectric (normally glass, ceramics, or the like) directly over a portion in the vicinity of the rotational antenna in a manner dividing a rotational antenna portion in the heating chamber. The high-frequency heating apparatus of this type has an area to carry the heated target larger than that in the case of the turntable, and allows easy cleaning because there is no part such as the turntable provided in the heating chamber. For these reasons, the high-frequency heating apparatus of this type has increasingly been used in households.

The rotational antenna type high-frequency heating apparatus, however, suffers from extremely higher possibility of occurrence of the bumping phenomenon described above. That is, in the rotational antenna type high-frequency heating apparatus, the food product is heated in a still state on the fixed base, and factors inducing the bumping phenomenon described above are increased. Consequently, risk of burn on the user is also increased.

The rotational antenna type microwave oven has conventionally been used widely for professional use. For example, the rotational antenna type microwave oven has been used in kitchen facilities in a convenience store or a restaurant. In the convenience store, the liquid is rarely heated, and the microwave oven is used mainly for re-heating a lunch box or bread. In addition, as the rotational antenna type microwave oven is used by professionals in these kitchen facilities, the users are familiar with how to use the rotational antenna type microwave oven.

On the other hand, though the rotational antenna type microwave oven starts to be used in a household, it is difficult for a housewife or even a child to understand the risk of the bumping phenomenon. Unless some measure is taken, the user is constantly exposed to risk of an accident such as sudden burn. In the heating and cooking apparatus and the microwave oven proposed in the publications above, in order to inform the user of such a risk, some heating and cooking apparatuses themselves attain a function to inform the user of the risk when heating is finished. Such measures, however, are still insufficient for preventing the risk of an accident such as burn.

Some conventional heating and cooking apparatuses include a structure to open the door by pressing a button. When the button is pressed, however, the door is fully opened at once. Then, the steam at a high temperature in the heating chamber is blown at a burst toward the user who attempts to take out the heated food product in front of the heating and cooking apparatus. Therefore, there has been a possibility of an accident such as burn on the user.

In addition, if the heated target includes liquid, the liquid may spill due to an opening/closing operation of the door when the food product is carried in the inside/outside of the heating chamber before or after heating.

Meanwhile, as to the heating and cooking apparatus such as a microwave oven, a forward draw-out type heating and cooking apparatus has conventionally been proposed. As a drawer type heating and cooking apparatus is suitable for a relatively large structure, it is considered as one of cooking apparatuses constituting a custom kitchen.

Japanese Patent Laying-Open No. 03-045820 proposes, as one example of the drawer type heating and cooking apparatus, a structure in which the bottom plate operating together with the door in the front can smoothly slide with respect to the apparatus main body by means of the slide mechanism, and an output from the motor provided in the apparatus main body is transmitted by the transmission means such as a rack and pinion mechanism, so as to open and close the door in association with the bottom plate. The door opening/closing device includes the latch device holding the door in the closing state, the door opening/closing switch, and the control circuit driving the motor so as to open and close the door upon receiving the signal from the door opening/closing switch. When the door opening/closing switch is pressed, latch is automatically released, and the door opens and closes in a manner cooperative with the bottom plate by driving force from the motor.

Japanese Patent Laying-Open No. 06-109257 proposes, as another example of the drawer type heating and cooking apparatus, a heating and cooking apparatus having a drawer body accommodating a heated target provided in a heating apparatus main body in such a manner that draw-out of the drawer body is allowed, in which when draw-out of the drawer body in a forward direction is detected, an electromagnet foot portion provided on a bottom surface of the cooking apparatus main body is excited such that it sticks to a metal base surface carrying the cooking apparatus. That is, when the drawer body accommodating a large amount of heated target is drawn out, the electromagnet foot portion sticks to the metal base surface. In this manner, falling of the drawer body in a forward-leaning manner from a kitchen counter, for example, due to unstable balance can be prevented.

Japanese Patent Laying-Open No. 11-237053 proposes, as yet another example of the drawer type heating and cooking apparatus, a microwave oven including a food carrier implemented as a movable drawer. In this microwave oven, a heating container having an opening in a top portion is provided in such a manner that it is freely drawn out of a housing of a microwave oven main body, and microwaves are shut by the heating container and a cover portion covering the opening of the heating container provided in the main body housing, so as to form a heating chamber. In this microwave oven, leakage of radio waves is prevented by providing a choke groove between an opening edge portion of the heating container and the cover portion faced thereto.

When a manual door opening/closing mechanism is employed in the drawer type heating and cooking apparatus, the user should determine and adjust an opening/closing speed of the door. Stated differently, the user can vary the opening/closing speed as he/she likes. On the other hand, it is impossible to open/close the door always at a same, constant speed. The user should determine a shape of a vessel and an amount of food (liquid) contained in the vessel, and should determine an appropriate door opening/closing speed. If the determined opening/closing speed is too fast, the food may spill from the vessel due to the impact at the time of start or stop of an opening/closing operation.

SUMMARY OF THE INVENTION

An object of the present invention is to provide a heating and cooking apparatus capable of preventing an accident when a user opens/closes a heating chamber or an accident when the user carries a food product as a heated target in the inside/outside of the heating chamber.

A heating and cooking apparatus according to one aspect of the present invention includes a cooking apparatus main body having a heating chamber; a drawer body including a base for carrying a heated target and formed such that the base moves from the inside of the heating chamber to the outside; a drive device for moving the drawer body; and a moving speed control device for controlling the drive device in order to vary a moving speed of the drawer body. The moving speed control device controls the drive device such that the moving speed of the drawer body at at least one stage selected from a group consisting of a draw-out initial stage in which the drawer body starts to move from the inside of the heating chamber of the cooking apparatus main body to the outside, a draw-out final stage in which the drawer body finishes to move from the inside of the heating chamber of the cooking apparatus main body to the outside, a push-in initial stage in which the drawer body starts to move from the outside of the heating chamber of the cooking apparatus main body to the inside, and a push-in final stage in which the drawer body finishes to move from the outside of the heating chamber of the cooking apparatus main body to the inside is relatively slower than the moving speed of the drawer body at an intermediate stage of a draw-out and push-in operation.

In the heating and cooking apparatus according to one aspect of the present invention, at at least one stage out of the draw-out initial stage in which the drawer body starts to move from the inside of the heating chamber to the outside, the draw-out final stage in which the drawer body finishes to move from the inside of the heating chamber to the outside, the push-in initial stage in which the drawer body starts to move from the outside of the heating chamber to the inside, and the push-in final stage in which the drawer body finishes to move from the outside of the heating chamber to the inside in the draw-out and push-in operation of the drawer body, the drawer body moves at a speed slower than that at the intermediate stage of the draw-out and push-in operation thereof by means of the moving speed control device. In this manner, as the drawer body moves at a slower speed at the initial stage or the final stage of the draw-out and push-in operation, falling of the heated target due to the impact in the draw-out and push-in operation can be prevented. In addition, when the heated target includes the liquid, spill of the liquid due to the impact in the draw-out and push-in operation can be prevented.

In addition, in the heating and cooking apparatus according to one aspect of the present invention, in the draw-out initial stage in which the drawer body starts to move from the inside of the heating chamber to the outside in the draw-out and push-in operation of the drawer body, the drawer body moves at a speed slower than that at the intermediate stage of the draw-out and push-in operation by means of the moving speed control device. Here, the steam produced from the heated target is blown from the heating chamber to the outside after heating. As the drawer body moves at a slow speed at the draw-out initial stage, the steam is blown at the draw-out initial stage not in a forward direction where the user is present but upward in an ensured manner. Therefore, the steam produced from the heated food product can be prevented from hitting the user.

In the heating and cooking apparatus according to one aspect of the present invention, preferably, the drawer body includes a heating container for accommodating the heated target.

In the heating and cooking apparatus according to one aspect of the present invention, preferably, the drawer body includes a door arranged in a front portion of the heating chamber, and the moving speed control device controls the drive device so as to gradually increase the moving speed of the door at an opening initial stage in which the door starts to open. Here, as the door moves at a relatively slow speed at the initial stage of an opening operation, falling of the heated target or spill of the liquid due to the impact in the opening operation can effectively be prevented. In addition, the steam produced from the heated food product can further effectively be prevented from hitting the user.

In the heating and cooking apparatus according to one aspect of the present invention, preferably, the drawer body includes a door arranged in a front portion of the heating chamber, and the moving speed control device controls the drive device such that the moving speed of the door is gradually increased at the opening initial stage in which the door starts to open and such that the drawer body moves while vibrating. In this manner, as the drawer body carrying the heated food product moves while vibrating at the opening initial stage, the bumping phenomenon that is hardly understood by the user can be prevented. Therefore, the risk of such an accident that the steam at a high temperature abruptly hits the user and causes burn can be prevented.

Preferably, the moving speed control device controls the drive device such that the drawer body moves while vibrating, by increasing and decreasing the moving speed of the door in a prescribed cycle at the opening initial stage in which the door starts to open.

In the heating and cooking apparatus according to one aspect of the present invention, preferably, the drawer body includes a door arranged in a front portion of the heating chamber, and the moving speed control device controls the drive device so as to gradually decrease the moving speed of the door at an opening final stage in which the door finishes to open. Here, as the door moves at a relatively slow speed at the final stage of the opening operation, falling of the heated target and spill of the liquid due to the impact in the opening operation can further effectively be prevented.

In the heating and cooking apparatus according to one aspect of the present invention, preferably, the drawer body includes a door arranged in a front portion of the heating chamber, and the moving speed control device controls the drive device so as to gradually increase the moving speed of the door at a closing initial stage in which the door starts to close. Here, as the door moves at a relatively slow speed at the initial stage of the closing operation, falling of the heated target and spill of the liquid due to the impact in the closing operation can further effectively be prevented.

Moreover, in the heating and cooking apparatus according to one aspect of the present invention, preferably, the drawer body includes a door arranged in a front portion of the heating chamber, and the moving speed control device controls the drive device so as to gradually decrease the moving speed of the door at a closing final stage in which the door finishes to close. Here, as the door moves at a relatively slow speed at the final stage of the closing operation, falling of the heated target and spill of the liquid due to the impact in the closing operation can further effectively be prevented.

In the heating and cooking apparatus according to one aspect of the present invention, preferably, the drawer body includes a door arranged in a front portion of the heating chamber, and the moving speed control device controls the drive device such that the moving speed of the door is maintained substantially constant at an intermediate stage of the opening operation or the closing operation of the door.

Another object of the present invention is to provide a drawer type heating and cooking apparatus in which a heating container can be drawn out in a forward direction with respect to a cooking apparatus main body, wherein a moving speed to move a drawer body including the heating container with respect to the cooking apparatus main body is restricted, in order to prevent spill of the heated target from a vessel in spite of the impact at the time of start or stop of the movement, thereby the heating container being kept clean.

The drawer type heating and cooking apparatus according to another aspect of the present invention includes a cooking apparatus main body in which a heating chamber for heating with a microwave is formed; and a drawer body arranged so as to be movable with respect to the cooking apparatus main body between a stored position at which the drawer body is stored in the heating chamber and a draw-out position at which the drawer body is drawn out of the heating chamber. The drawer body moves at a speed of at most 12 cm/s.

In the drawer type heating and cooking apparatus according to another aspect of the present invention, when the drawer body is moved to an external draw-out position, the heated target can be placed on the drawer body. When the drawer body is in the stored position in the heating chamber, the heated target can be heated with microwaves. As the drawer body moves at a speed of at most 12 cm/s, it can be confirmed that there is no spill of the heated target when a general heated target represented by food contained in a vessel is heated.

The drawer type heating and cooking apparatus according to another aspect of the present invention may include a slide mechanism enabling the drawer body to move with respect to the cooking apparatus main body, and a drive mechanism driving the slide mechanism and determining a moving speed of the drawer body in accordance with a magnitude of an output. Means such as a motor is adopted as the drive mechanism. In designing its output speed, a drive speed of the slide mechanism, that is, the moving speed of the drawer body, can be set to not larger than 12 cm/s. By restricting the speed in such a manner, the drawer body can be moved at a constant speed whatever the heated target may be.

In the drawer type heating and cooking apparatus according to another aspect of the present invention, preferably, the drive mechanism is formed such that the drawer body can move at a speed of at least 8 cm/s. If it takes longer than four to five seconds for the drawer body to move between the stored position and the draw-out position, the user feels uncomfortable because waiting time is too long. When the moving speed of the drawer body is set to at least 8 cm/s, the drawer body can move between the stored position and the draw-out position in four to five seconds, in which case, uncomfortable feeling of most users originating from too long waiting time can be avoided.

Preferably, in the drive mechanism, the moving speed of the drawer body can be set to any value in a speed range described above. For example, when the heated target is a solid free from spill, the moving speed can be set to a high speed.

In addition, preferably, in the drive mechanism, the drawer body substantially instantaneously accelerates to the moving speed or substantially instantaneously stops from the moving speed, at the time of start and stop of movement of the drawer body. The spill of the heated target from the vessel is actually caused by inertial force from acceleration of the drawer body, that is, the container. As the drawer body is moved in such a manner that the user feels as if the drawer body is substantially instantaneously started and stopped, a degree of rocking of the heated target can be associated with a substantial moving speed when the drawer body moves between the stored position and the draw-out position. In addition, as the heated target receives the impact at the time of start and stop, blow-out of the vapor ends at an early stage, and such a bumping phenomenon that the vapor blows out when the heating container is drawn out and taken out after heating does not occur.

In the drawer type heating and cooking apparatus according to another aspect of the present invention, preferably, the drawer body includes a door and a heating container attached to the door and accommodating a heated target. While the drawer body is in the stored position, the door is arranged to close an opening of the heating chamber and the heating container is stored in the heating chamber. According to such a drawer type heating and cooking apparatus, while the drawer body is in the stored position, the door closes the opening of the heating chamber and the heating container is stored in the heating chamber. In this manner, leakage to the outside of the microwaves emitted into the heating chamber can be prevented.

In the drawer type heating and cooking apparatus according to another aspect of the present invention, the drive mechanism may include a drive motor attached to the cooking apparatus main body, and a rack and pinion mechanism consisting of a pinion turned by the drive motor and a rack attached to the drawer body and engaged with the pinion. Output rotation of the drive motor is converted to slide movement of the drawer body via the rack and pinion mechanism. The slide mechanism includes a fixed rail attached to the cooking apparatus main body and a movable rail that is attached to the drawer body and movable relative to the fixed rail, whereby the rack of the drive mechanism can be attached to the movable rail. Here, the output rotation of the drive motor is converted to slide movement, and transmitted from the pinion through the rack and the movable rail having the rack attached as slide movement with respect to the drawer body.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

An embodiment of the present invention will be described hereinafter with reference to the drawings.

Figure 1:
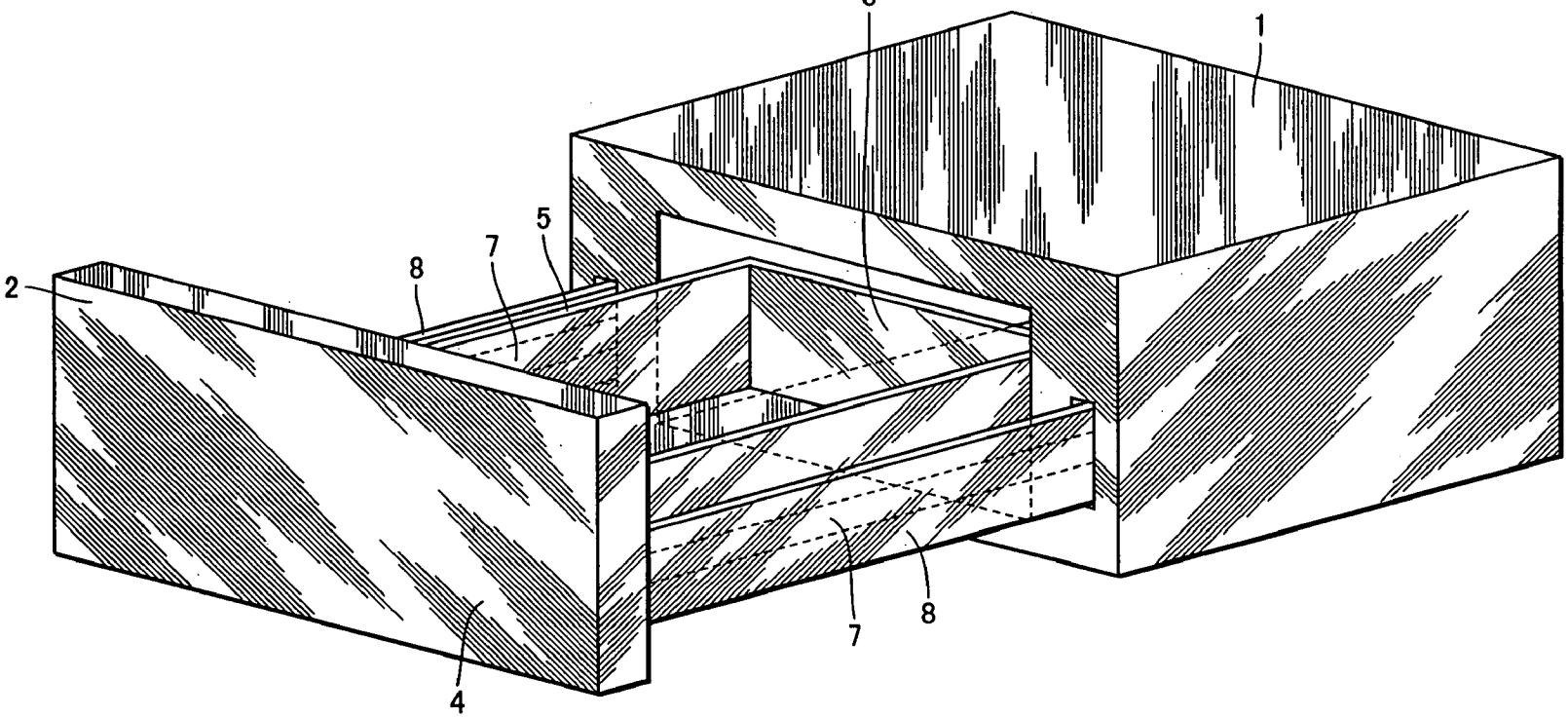
FIG. 1 is a perspective view schematically showing an appearance of a heating and cooking apparatus representing one embodiment of the present invention.

FIG. 1 is a perspective view schematically showing an appearance of a heating and cooking apparatus representing one embodiment of the present invention.

As shown in FIG. 1, a cooking apparatus main body 1 includes a heating chamber 3 for heating and cooking the heated target. A drawer body 2 is arranged to be movable, that is, slidable, between the inside and the outside of cooking apparatus main body 1, such that it can be drawn out from the inside of heating chamber 3 of cooking apparatus main body 1 to the outside. The heating and cooking apparatus includes a slide rail 7 serving as a moving mechanism for moving drawer body 2 between the inside and the outside of cooking apparatus main body 1 in a slid manner. Drawer body 2 includes a door 4 for opening/closing heating chamber 3 and a heating container 5 for carrying and accommodating the heated target. Heating container 5 has sidewalls on left and right sides, a rear wall on a rear side in heating chamber 3 of cooking apparatus main body 1, and an opening in an upper portion. Heating container 5 has door 4 attached in the front. When door 4 closes the opening of heating chamber 3, an internal space of heating chamber 3 implements a space sealed by inner wall surfaces of cooking apparatus main body 1 and drawer body 2.

Door 4 of drawer body 2 is supported in cooking apparatus main body 1 by left and right sidewall surfaces located outside heating chamber 3 with slide rail 7 being interposed. Slide rail 7 consists of a fixed rail and a movable rail sliding along the fixed rail. The fixed rail is attached to left and right wall surfaces outside heating chamber 3. The movable rail is attached to door 4 so as to extend from an inner wall surface of door 4 of drawer body 2 toward heating chamber 3 of cooking apparatus main body 1, with an L-shaped angle member 8 attached on the inner wall surface of door 4 being interposed.

Figure 2:
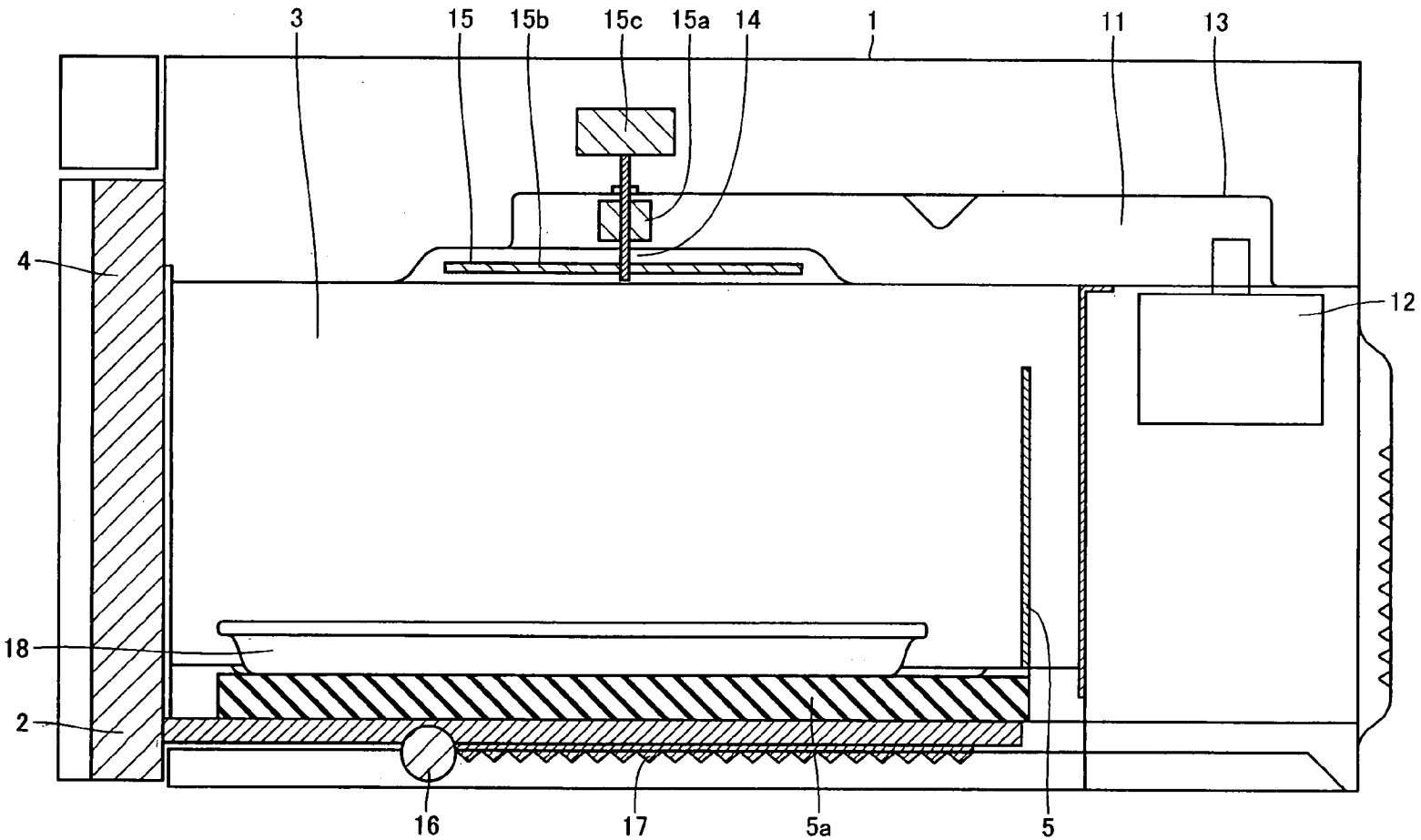
FIG. 2 schematically shows a structure of the heating and cooking apparatus representing one embodiment of the present invention, in a partial cross-section viewed from a side surface in parallel to a direction in which a drawer body is drawn out.

FIG. 2 schematically shows a structure of the heating and cooking apparatus representing one embodiment of the present invention, in a partial cross-section viewed from a side surface in parallel to a direction in which the drawer body is drawn out.

As shown in FIG. 2, a microwave generator 11 serving as a high-frequency generator is arranged outside the top portion and the rear portion of heating chamber 3 in cooking apparatus main body 1. Microwave generator 11 consists of a magnetron 12 arranged outside the rear portion of heating chamber 3 and generating a microwave, and a waveguide 13 arranged outside the top portion of heating chamber 3 and propagating the microwave generated by magnetron 12. The microwave generated by magnetron 12 is propagated through waveguide 13. The microwave generated by magnetron 12 is guided by waveguide 13 outside heating chamber 3, and passes through a feeder opening 14 implemented by a hole of a small diameter provided in an upper wall surface of heating chamber 3. Then, the microwave is uniformly emitted into heating chamber 3 from the upper portion of heating chamber 3 by a rotational antenna 15 consisting of a reception antenna portion 15*a* and an emission antenna portion 15*b* and rotated by a motor 15*c*. In this manner, the heated target accommodated in heating container 5 of drawer body 2 arranged in heating chamber 3 is heated and cooked by the microwave supplied to heating chamber 3 through feeder opening 14.

Heating container 5 includes a fixed base 5*a* for carrying the heated target. Fixed base 5*a* is arranged directly below rotational antenna 15 and formed with a dielectric. The heated target is placed on a tray 18 and the tray 18 is arranged on fixed base 5*a*. A rack 17 is attached to door 4 of drawer body 2. Teeth of rack 17 are formed so as to engage with pinion gears attached to a rotation shaft of a door drive motor (DC motor) 16 serving as a drive device for moving door 4. In this manner, a mechanism for automatically moving drawer body 2, that is, an automatic opening/closing mechanism for automatically opening/closing door 4, is implemented. As a result of rotation of door drive motor 16 in forward and reverse directions, the pinion gears attached to the rotation shaft rotate, and rack 17 linearly moves in a left-right direction in FIG. 2 in accordance with the rotation. In accordance with movement of rack 17, tray 18 accommodated in heating container 5 of drawer body 2 and placed on fixed base 5*a* is moved. That is, drawer body 2 is moved (door 4 is moved). In this manner, when drawer body 2 is automatically moved by door drive motor 16, the heated target placed on tray 18 is also automatically moved between the inside and the outside of heating chamber 3.

Figure 3:
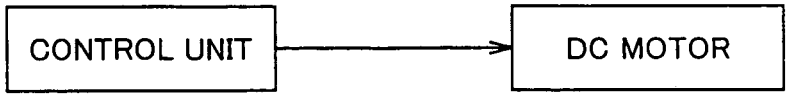
FIG. 3 is a block diagram showing control of a door motor of the heating and cooking apparatus representing one embodiment of the present invention.

FIG. 3 is a block diagram showing control of the door motor of the heating and cooking apparatus representing one embodiment of the present invention. As shown in FIG. 3, the control unit provided inside cooking apparatus main body 1 controls door drive motor (DC motor) 16.

Figure 4:
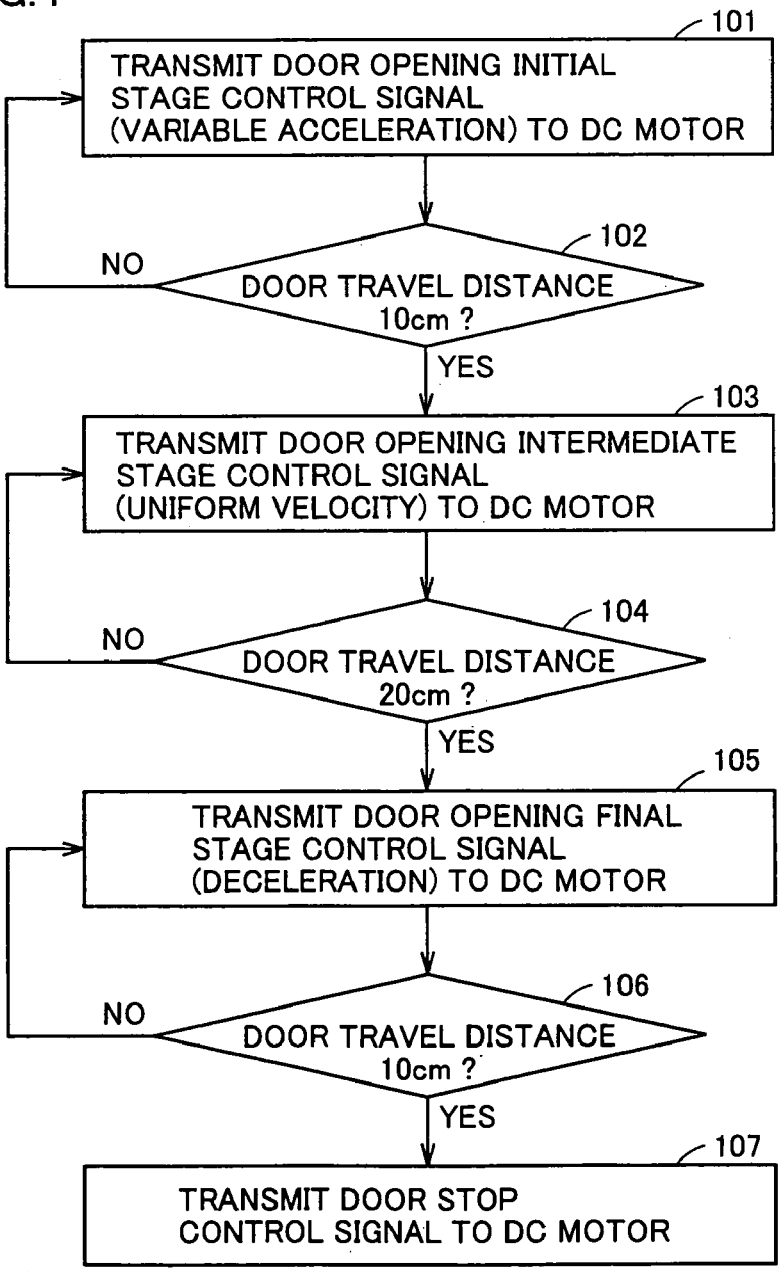
FIG. 4 shows a control flow in an opening operation of the door of the heating and cooking apparatus representing one embodiment of the present invention.

FIG. 4 shows a control flow in the opening operation of the door of the heating and cooking apparatus representing one embodiment of the present invention.

As shown in FIG. 4, in the opening operation of door 4, initially at step 101, the control unit transmits a door opening initial stage control signal (variable acceleration) to door drive motor (DC motor) 16. Then, door 4 starts to move with its speed increased. At step 102, when the control unit determines that a door travel distance has attained to 10 cm, for example, the control unit transmits a door opening intermediate stage control signal (uniform velocity) to door drive motor 16, as shown at step 103. Then, door 4 moves at a substantially constant speed. Thereafter, at step 104, when the control unit determines that the door travel distance has attained to 20 cm at the substantially constant speed, for example, the control unit transmits a door opening final stage control signal (deceleration) to door drive motor 16, as shown at step 105. Then, door 4 moves with its speed decreased. When the control unit determines that the door travel distance has attained to 10 cm, for example, the control unit transmits a door stop control signal to door drive motor 16, as shown at step 106. Then, door 4 stops. In the present embodiment, the moving speed of door 4 is set to 10 cm/sec at the maximum. It is noted that the closing operation of door 4 is controlled in a similar manner.

Figure 5:
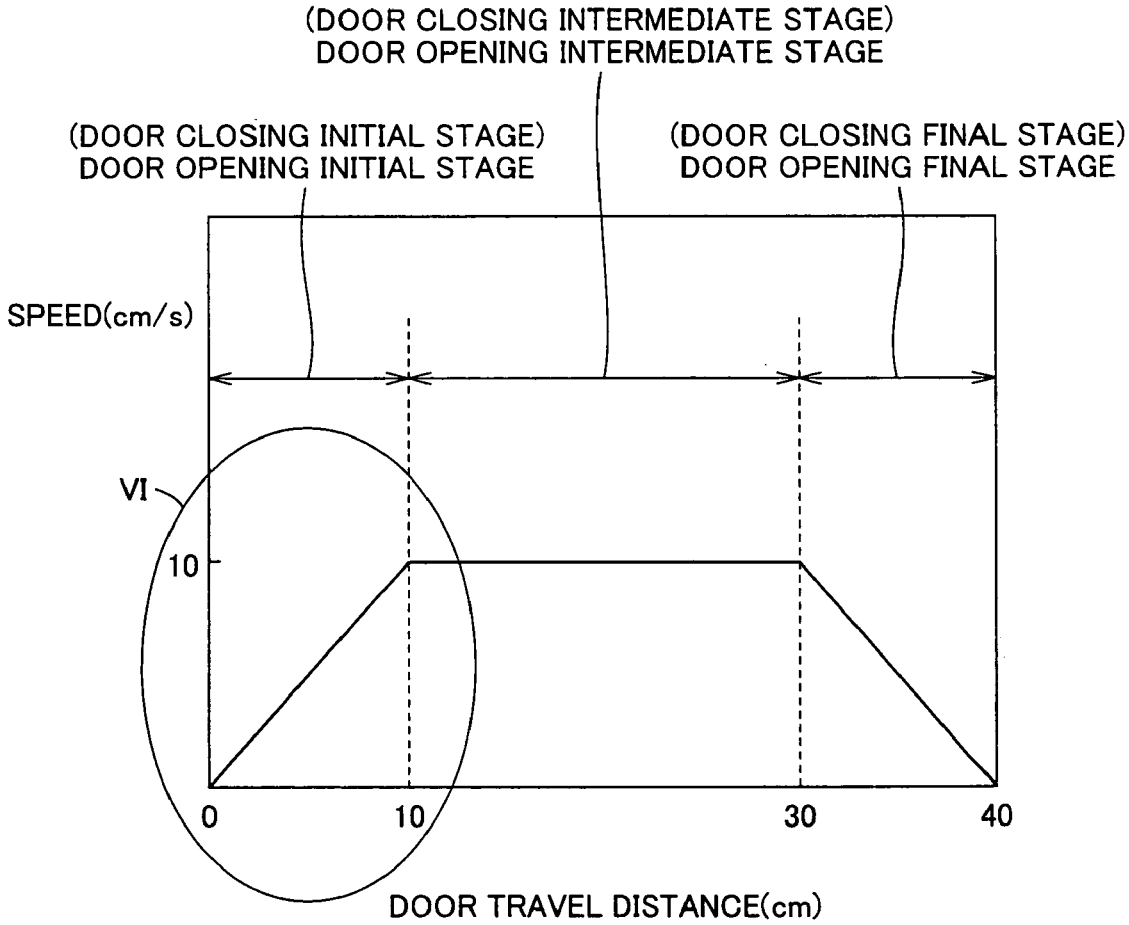
FIG. 5 shows a relation between a travel distance and a moving speed of the door of the heating and cooking apparatus representing one embodiment of the present invention.
Figure 6:
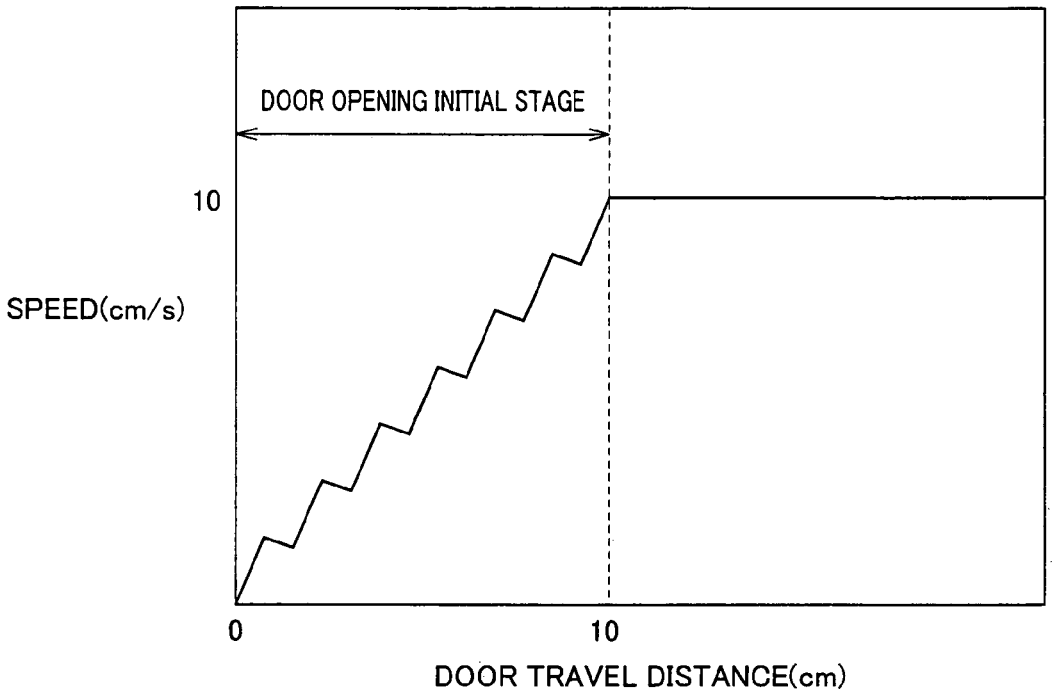
FIG. 6 shows a relation between a travel distance and a moving speed at an opening initial stage of the door, by enlarging a portion shown with VI in FIG. 5.

FIG. 5 shows a relation between a travel distance and a moving speed of the door of the heating and cooking apparatus representing one embodiment of the present invention. FIG. 6 shows a relation between a travel distance and a moving speed at the opening initial stage of the door, by enlarging a portion shown with VI in FIG. 5.

As shown in FIG. 5, under the control shown in FIG. 4, door 4 moves with its moving speed gradually increased at the door opening initial stage in which door 4 starts to open, moves at a substantially constant speed at the opening operation intermediate stage, moves with its moving speed gradually decreased at the opening final stage in which door 4 finishes to open, and finally stops at a state that the door is fully opened. In addition, in a manner the same as shown in FIG. 4, door 4 moves with its moving speed gradually increased at the door closing initial stage in which door 4 starts to close, moves at a substantially constant speed at the closing operation intermediate stage, moves with its moving speed gradually decreased at the closing final stage in which door 4 finishes to close, and finally stops at a state that the door is closed.

As shown in FIG. 6, under the control shown in FIG. 4, door 4 moves with its moving speed gradually increased at the door opening initial stage in which door 4 starts to open by increasing and decreasing the moving speed in a prescribed cycle. In the present embodiment, door 4 moves while acceleration and deceleration is repeated in a cycle of approximately 0.06 second. In this manner, at the door opening initial stage, door 4 moves while vibrating. That is, drawer body 2 moves while vibrating.

Figure 7:
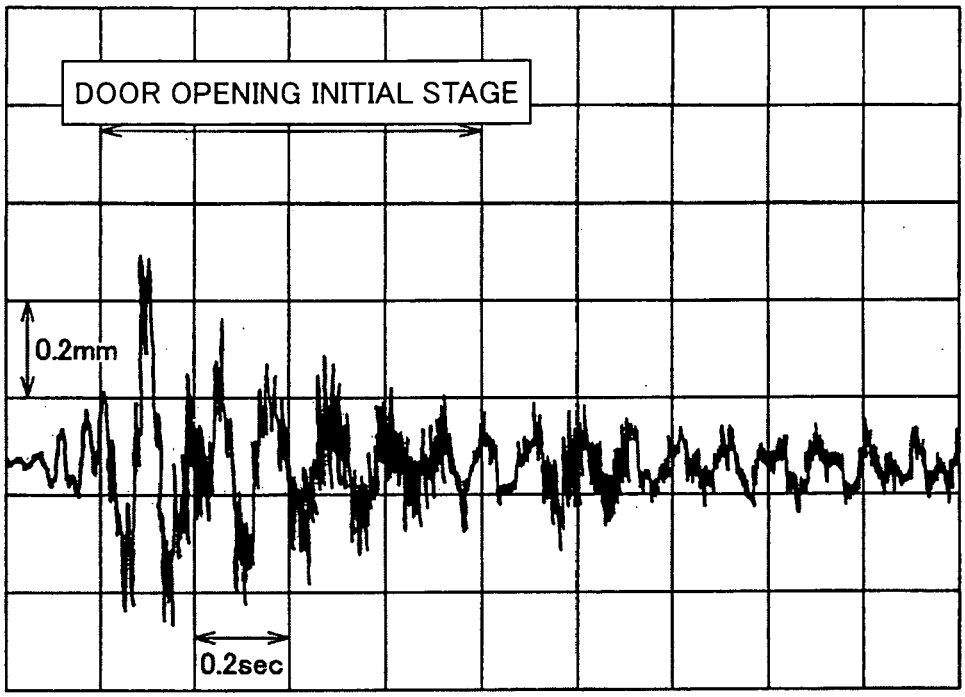
FIG. 7 shows slight vibration caused in the drawer body at the opening initial stage of the door of the heating and cooking apparatus representing one embodiment of the present invention.

FIG. 7 shows slight vibration caused in the drawer body at the opening initial stage of the door of the heating and cooking apparatus representing one embodiment of the present invention.

As shown in FIG. 7, by controlling the moving speed of door 4 shown in FIGS. 4 and 6, slight vibration with an amplitude relatively larger than that at the door opening intermediate stage is produced in door 4, that is, in drawer body 2, at the door opening initial stage.

Figure 8:
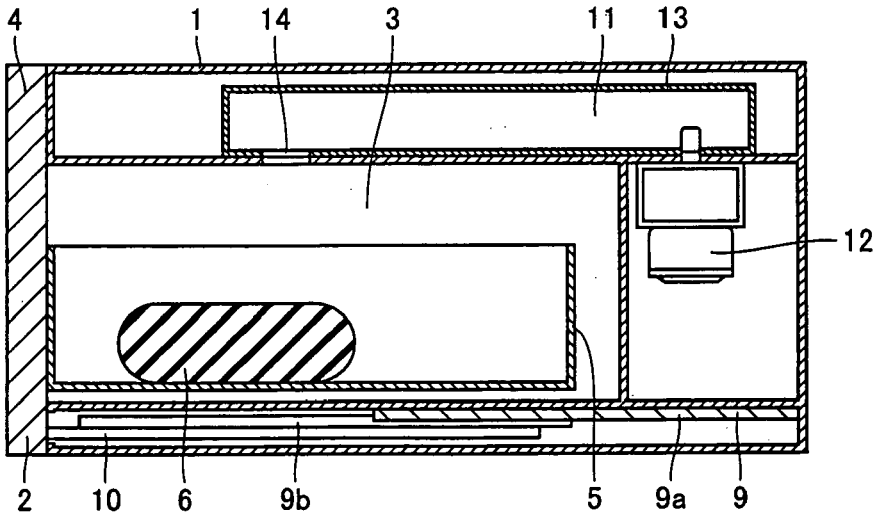
FIG. 8 shows a closed state of the door in a cross-section viewed from the side surface of the heating and cooking apparatus in parallel to a direction in which the drawer body is drawn out, as one embodiment of the present invention.
Figure 9:
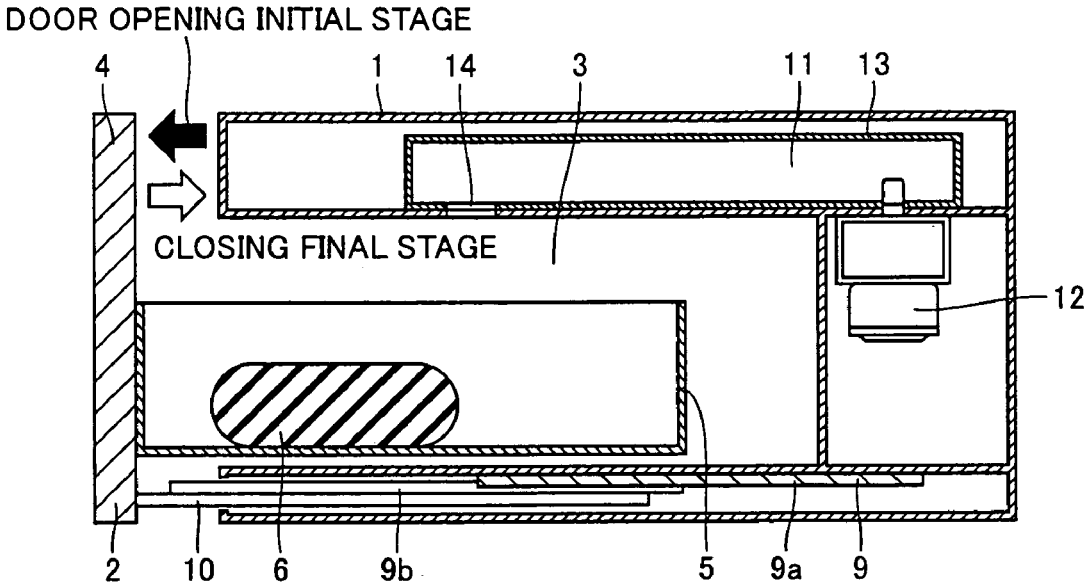
FIG. 9 shows a state at the opening initial stage or a closing final stage in an operation of the door, in a cross-section viewed from the side surface of the heating and cooking apparatus in parallel to a direction in which the drawer body is drawn out, as one embodiment of the present invention.
Figure 10:
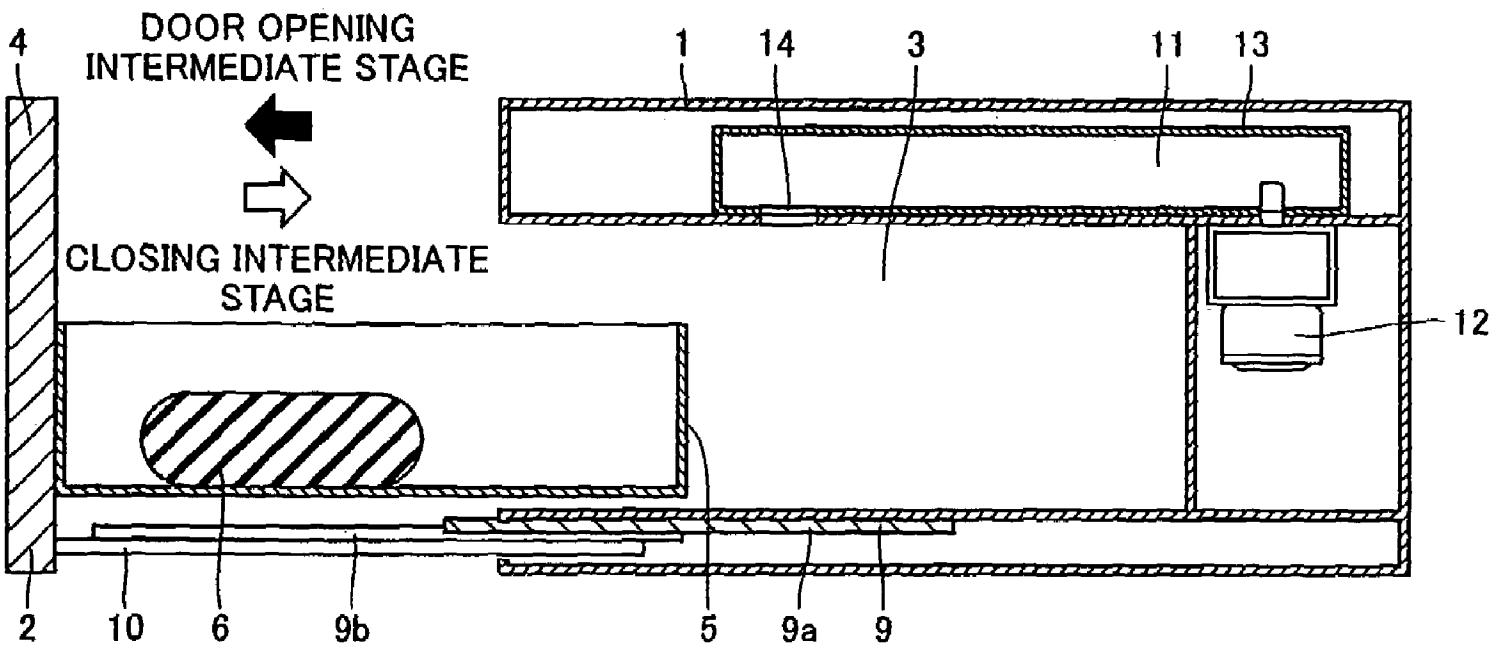
FIG. 10 shows a state at an opening intermediate stage or a closing intermediate stage in the operation of the door, in a cross-section viewed from the side surface of the heating and cooking apparatus in parallel to a direction in which the drawer body is drawn out, as one embodiment of the present invention.
Figure 11:
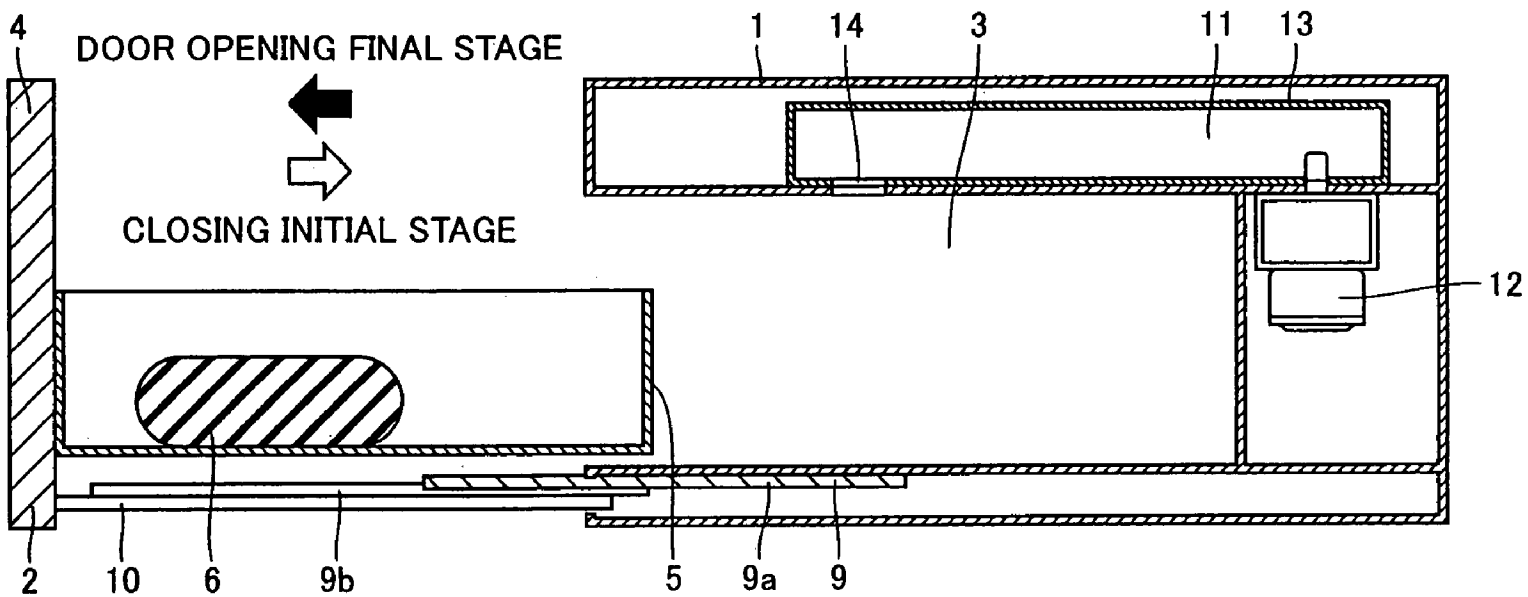
FIG. 11 shows a state at an opening final stage or a closing initial stage in the operation of the door, in a cross-section viewed from the side surface of the heating and cooking apparatus in parallel to a direction in which the drawer body is drawn out, as one embodiment of the present invention.

FIG. 8 shows a closed state of the door in a cross-section viewed from the side surface of the heating and cooking apparatus in parallel to a direction in which the drawer body is drawn out, as one embodiment of the present invention. FIG. 9 shows a state at the opening initial stage or the closing final stage in the operation of the door. FIG. 10 shows a state at the opening intermediate stage or the closing intermediate stage in the operation of the door. FIG. 11 shows a state at the opening final stage or the closing initial stage in the operation of the door.

As shown in the order of FIGS. 8, 9, 10, and 11, when a heated target 6 is taken out of heating chamber 3 after heating thereof, a draw-out operation of drawer body 2 is carried out. That is, the opening operation of door 4 is carried out. In addition, as shown in the order of FIGS. 11, 10, 9, and 8, when heated target 6 is accommodated in heating chamber 3 before starting heating thereof, a push-in operation of drawer body 2 is carried out. That is, the closing operation of door 4 is carried out.

As shown in FIGS. 8 to 11, as a structure of a moving mechanism, in addition to slide rails 7 (FIG. 1) provided on the left and right sidewall surfaces located outside heating chamber 3, door 4 of drawer body 2 is supported in cooking apparatus main body 1 by a bottom wall surface located outside heating chamber 3 with a slide rail 9 being interposed. Slide rail 9 consists of a fixed rail 9*a* and a movable rail 9*b* sliding along fixed rail 9*a*. Fixed rail 9*a* is attached to the bottom wall surface outside heating chamber 3 of cooking apparatus main body 1. Movable rail 9*b* is attached to door 4 so as to extend from the inner wall surface of door 4 toward heating chamber 3 of cooking apparatus main body 1, with an L-shaped angle member 10 attached on the inner wall surface of door 4 being interposed.

In the heating and cooking apparatus representing one embodiment of the present invention described above, under the control of the control unit (FIGS. 3 and 4) serving as the moving speed control device, at least one stage out of the opening initial stage in which door 4 starts to open, the opening final stage in which door 4 finishes to open, the closing initial stage in which door 4 starts to close, and the closing final stage in which door 4 finishes to close of the operation of door 4, door 4 moves at a speed slower than that at the opening/closing operation intermediate stage, as shown in FIG. 5. In this manner, as door 4 moves at a slower speed in the initial stage or the final stage of the opening/closing operation, falling of heated target 6 due to the impact in the opening/closing operation can be prevented. In addition, when heated target 6 includes the liquid, spill of the liquid due to the impact in the opening/closing operation can be prevented.

In other words, in the heating and cooking apparatus representing one embodiment of the present invention, under the control of the control unit (FIGS. 3 and 4) serving as the moving speed control device, at least one stage out of the draw-out initial stage in which drawer body 2 starts to move from the inside of heating chamber 3 to the outside, the draw-out final stage, the push-in initial stage in which drawer body 2 starts to move from the outside of heating chamber 3 to the inside, and the push-in final stage of the draw-out and push-in operation of drawer body 2, drawer body 2 moves at a speed slower than that at the intermediate stage of the draw-out and push-in operation of drawer body 2, as shown in FIG. 5. In this manner, as drawer body 2 moves at a slower speed in the initial stage or the final stage of the draw-out and push-in operation, falling of heated target 6 due to the impact in the draw-out and push-in operation can be prevented. In addition, when heated target 6 includes the liquid, spill of the liquid due to the impact in the draw-out and push-in operation can be prevented.

In the heating and cooking apparatus representing one embodiment of the present invention, under the control of the control unit (FIGS. 3 and 4) serving as the moving speed control device, at the opening initial stage in which door 4 starts to open in the operation of door 4, door 4 moves at a speed slower than that at the intermediate stage of the opening/closing operation. After heating, the steam produced from heated target 6 is blown from heating chamber 3 to the outside. Here, as door 4 moves at a slower speed at the opening initial stage, the steam is blown at the opening initial stage not in a forward direction where the user is present but upward in an ensured manner. Therefore, the steam produced from the heated food product can be prevented from hitting the user.

In other words, in the heating and cooking apparatus representing one embodiment of the present invention, under the control of the control unit (FIGS. 3 and 4) serving as the moving speed control device, at the draw-out initial stage in which drawer body 2 starts to move from the inside of heating chamber 3 to the outside in the draw-out and push-in operation of drawer body 2, drawer body 2 moves at a speed slower than that at the intermediate stage of the draw-out and push-in operation. After, heating, the steam produced from heated target 6 is blown from heating chamber 3 to the outside. Here, as drawer body 2 moves at a slower speed at the draw-out initial stage, the steam is blown at the draw-out initial stage not in a forward direction where the user is present but upward in an ensured manner. Therefore, the steam produced from the heated food product can be prevented from hitting the user.

Figure 12:
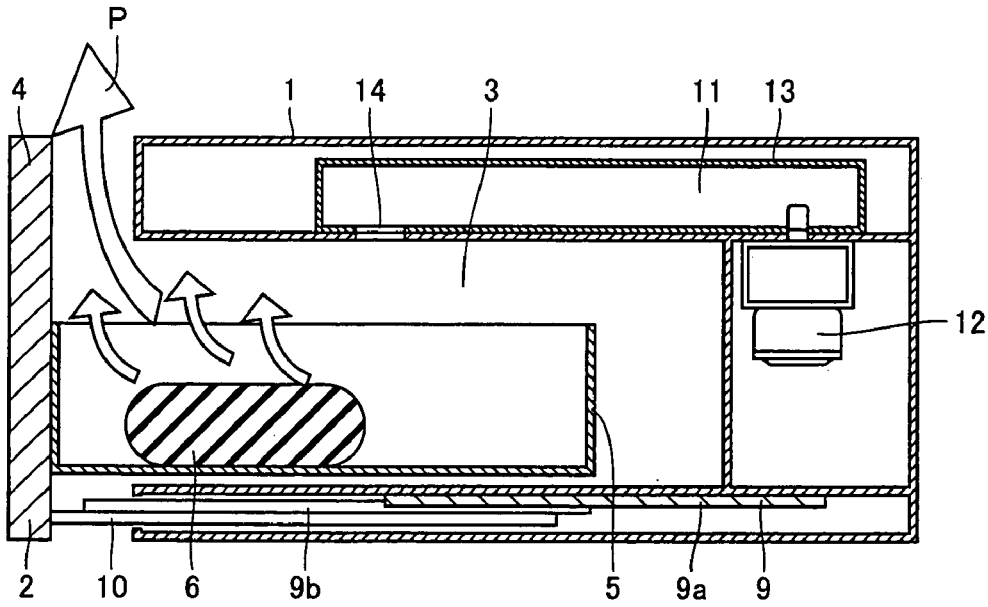
FIG. 12 shows a steam blow state at the opening initial stage, in a cross-section viewed from the side surface of the heating and cooking apparatus in parallel to a direction in which the drawer body is drawn out, as one embodiment of the present invention.

FIG. 12 shows a steam blow state at the opening initial stage, in a cross-section viewed from the side surface of the heating and cooking apparatus in parallel to a direction in which the drawer body is drawn out, as one embodiment of the present invention.

As shown in FIG. 12, door 4 starts to open at a relatively slow speed at the opening initial stage of the operation to open door 4. Therefore, steam P heated to a high temperature and filling heating chamber 3 can be blown from heating chamber 3 to the outside in a safe state. Here, the safe state refers to a state in which blown high-temperature steam P is emitted not in a forward direction of cooking apparatus main body 1, that is, a direction toward the user who takes out the heated food as heated target 6, but upward direction from the opening between a front wall and door 4 along the front wall of cooking apparatus main body 1. That is, the safe state refers to the state in which the steam at a high temperature is not blown toward the user.

Figure 13:
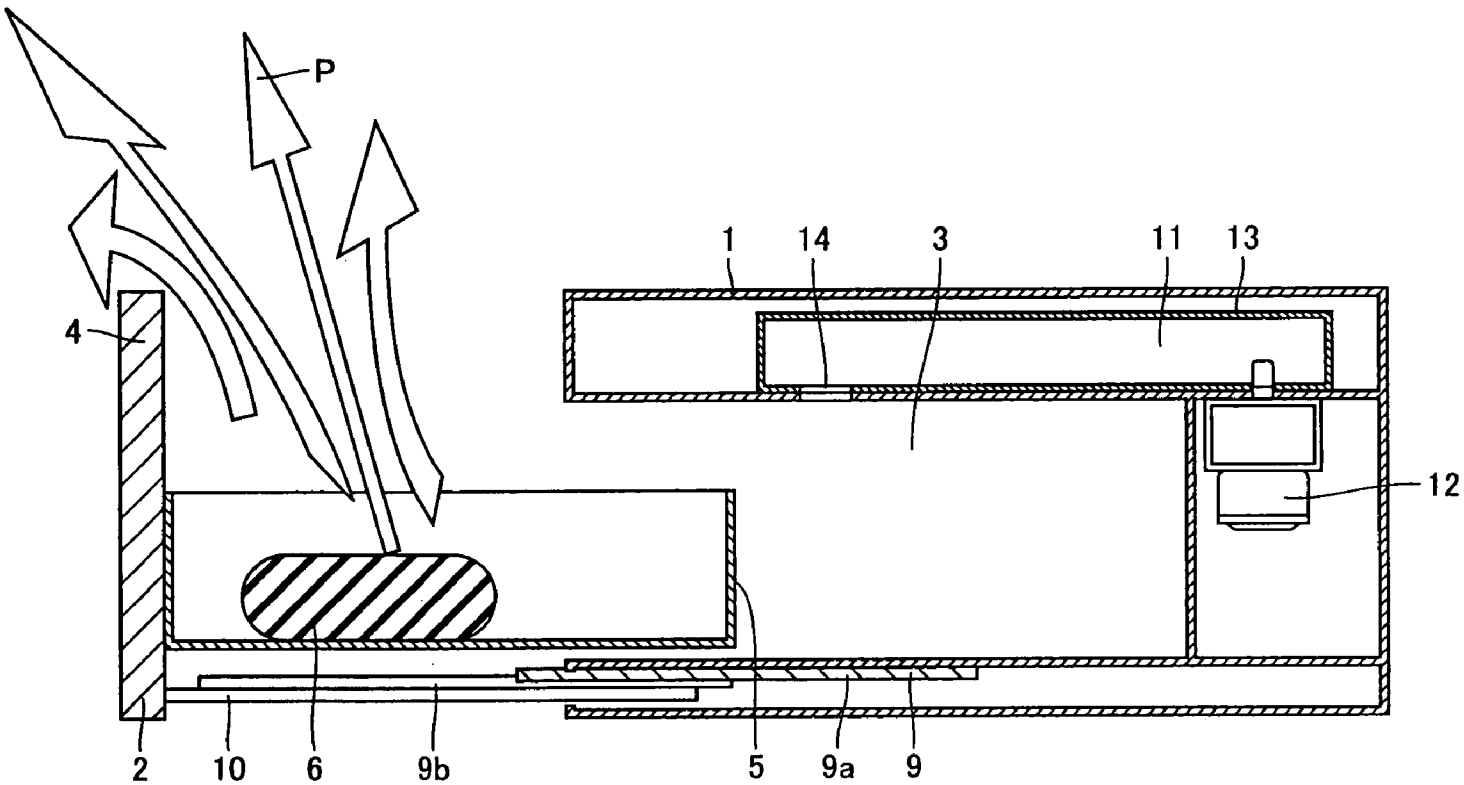
FIG. 13 shows a steam blow state at the opening initial stage, in a cross-section viewed from the side surface of the heating and cooking apparatus in parallel to a direction in which the drawer body is drawn out, shown as a comparative example of the present invention.

FIG. 13 shows a steam blow state at the opening initial stage, in a cross-section viewed from the side surface of the heating and cooking apparatus in parallel to a direction in which the drawer body is drawn out, shown as a comparative example of the present invention.

As shown in FIG. 13 in comparison with FIG. 12, when door 4 starts to open at a relatively high speed at the opening initial stage of the operation to open door 4, blown high-temperature steam P is emitted not only upward of cooking apparatus main body 1 but also in a forward direction, that is, the direction toward the user who takes out the heated food as heated target 6.

In the embodiment described above, drawer body 2 includes door 4 and heating container 5 accommodating heated target 6, and heating container 5 includes fixed base 5*a*. Drawer body 2 may be structured to move in accordance with the opening/closing operation of door 4. Here, though door 4 is structured to attain slide movement (linear movement) by means of the moving mechanism in the embodiment described above, door 4 may be structured such that the opening/closing operation of door 4 is carried out by pivot thereof and drawer body 2 is moved in accordance with that pivot. According to such a structure, an effect similar to that in the embodiment above can also be achieved.

Though fixed base 5*a* is adopted in the embodiment above, the present invention may be applied to the high frequency heating and cooking apparatus adopting a turntable instead of rotational antenna 15. Here, an effect similar to that in the embodiment above can also be achieved. In addition, an effect similar to that in the embodiment above can be achieved also if an additional heat source such as a heater different from a high-frequency heat source is provided in cooking apparatus main body 1.

Moreover, in the heating and cooking apparatus representing one embodiment of the present invention described above, the control unit (FIGS. 3 and 4) serving as the moving speed control device controls door drive motor (DC motor) 16 serving as the drive device so as to gradually increase the moving speed of door 4 at the opening initial stage in which door 4 starts to open as shown in FIG. 5 and so as to move drawer body 2 in a vibrated manner as shown in FIGS. 6 and 7. In this manner, as drawer body 2 carrying heated target 6 moves while vibrating at the opening initial stage, such a bumping phenomenon that is hardly understood by the user can be prevented. Therefore, such an accident that the high-temperature steam abruptly hits the user and causes burn can be prevented. Even if heated target 6 is heated and is in a critical state in which a factor causing the bumping phenomenon is present, the bumping phenomenon can end by the time when door 4 fully opens. Therefore, when heated target 6 that has been heated is taken out, the safe state has been achieved.

In the embodiment described above, the control unit (FIGS. 3 and 4) serving as the moving speed control device controls door drive motor 16 serving as the drive device such that drawer body 2 moves while it is vibrated by increasing and decreasing the moving speed of door 4 in a prescribed cycle at the opening initial stage in which door 4 starts to open as shown in FIG. 6. On the other hand, if slight vibration as shown in FIG. 7 can be applied to drawer body 2, door drive motor 16 serving as the drive device may be controlled in a manner different from that in the embodiment above. Specifically, an additional drive device for applying slight vibration to drawer body 2 may be provided.

As described above, according to the present invention, an accident when the user opens/closes the heating chamber or an accident when the user carries the food product as the heated target in the inside/the outside of the heating chamber can be prevented.

Second Embodiment

Figure 14:
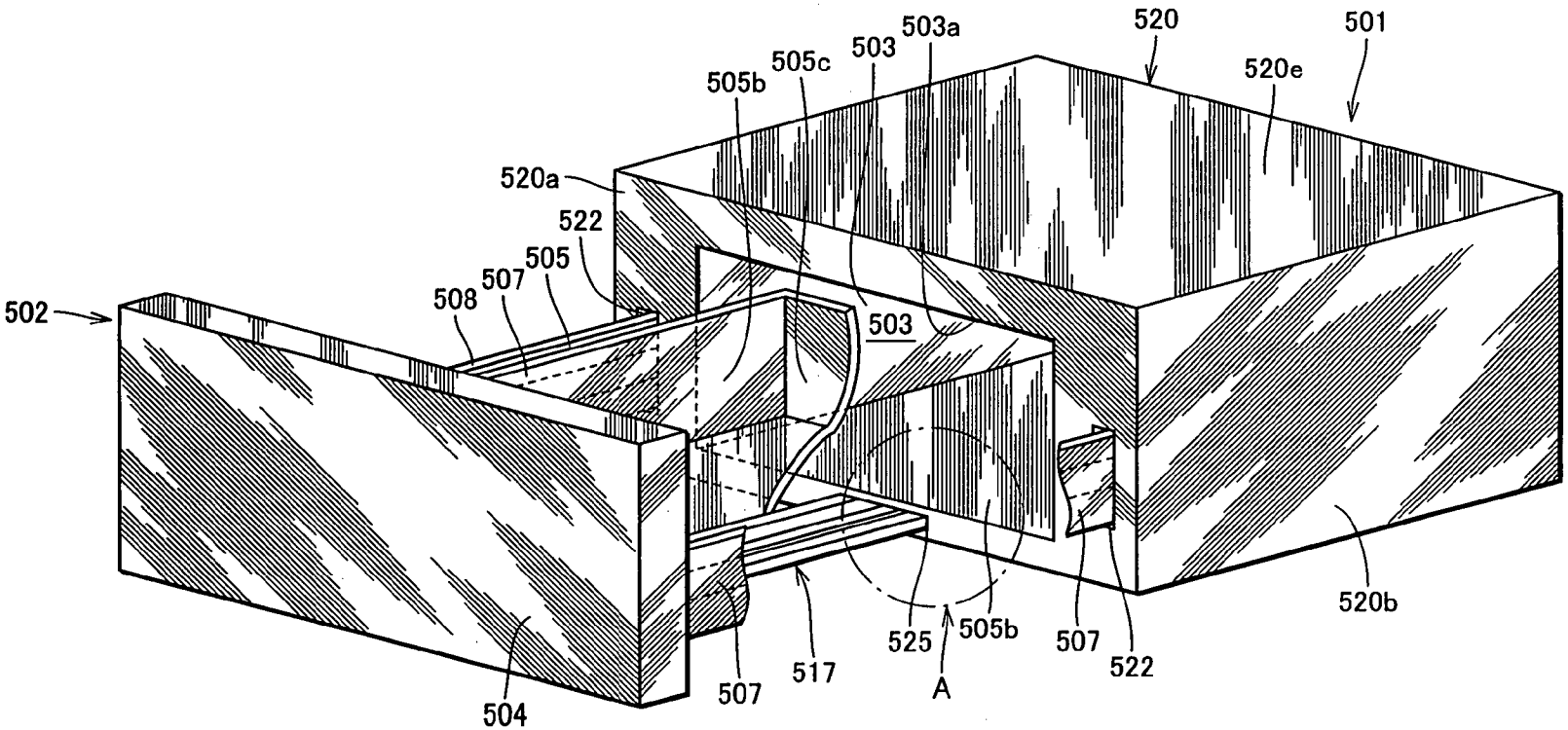
FIG. 14 is a perspective view showing an overall appearance of another embodiment of the heating and cooking apparatus according to the present invention.
Figure 15:
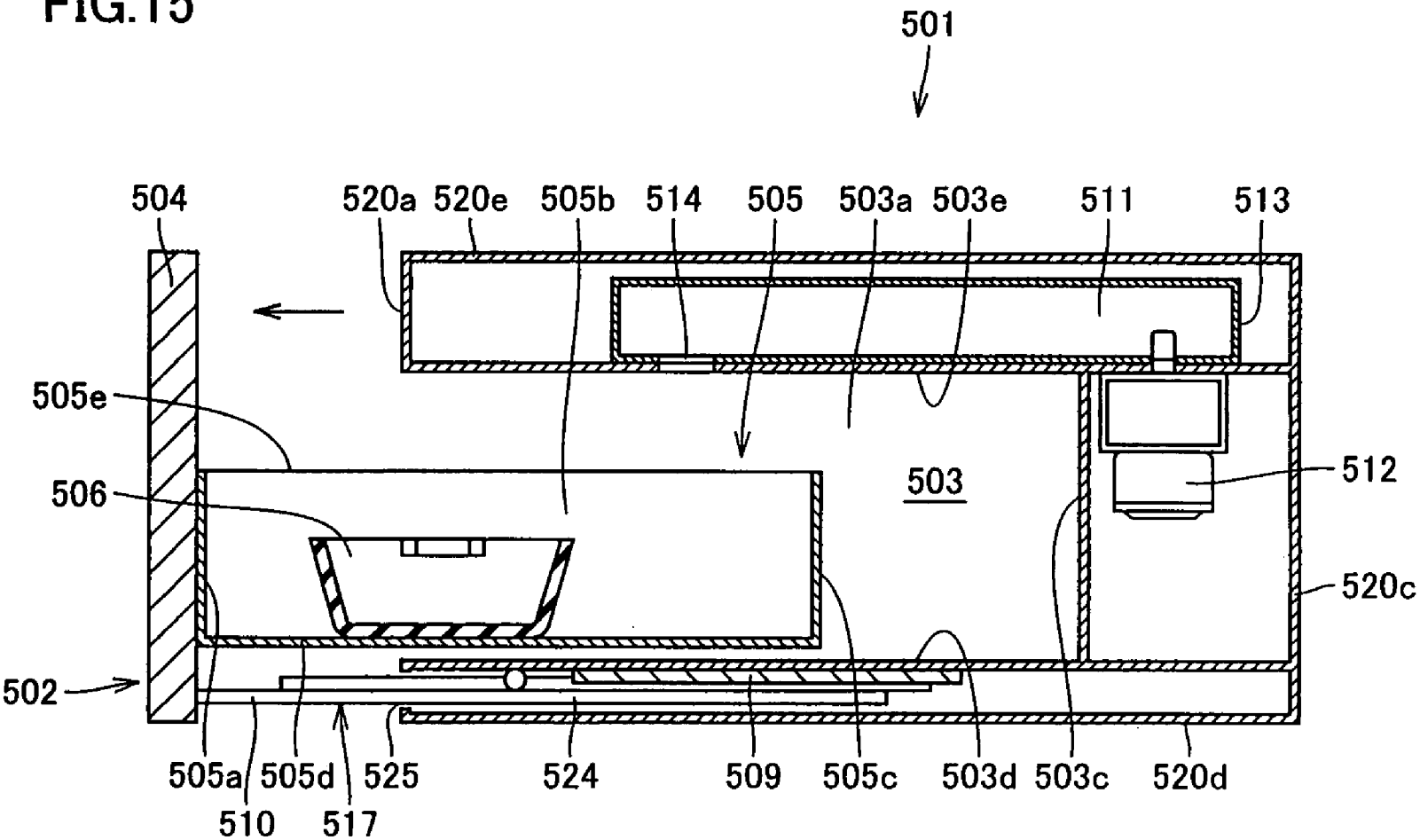
FIG. 15 is a cross-sectional view of the heating and cooking apparatus shown in FIG. 14 viewed from the side.
Figure 16:
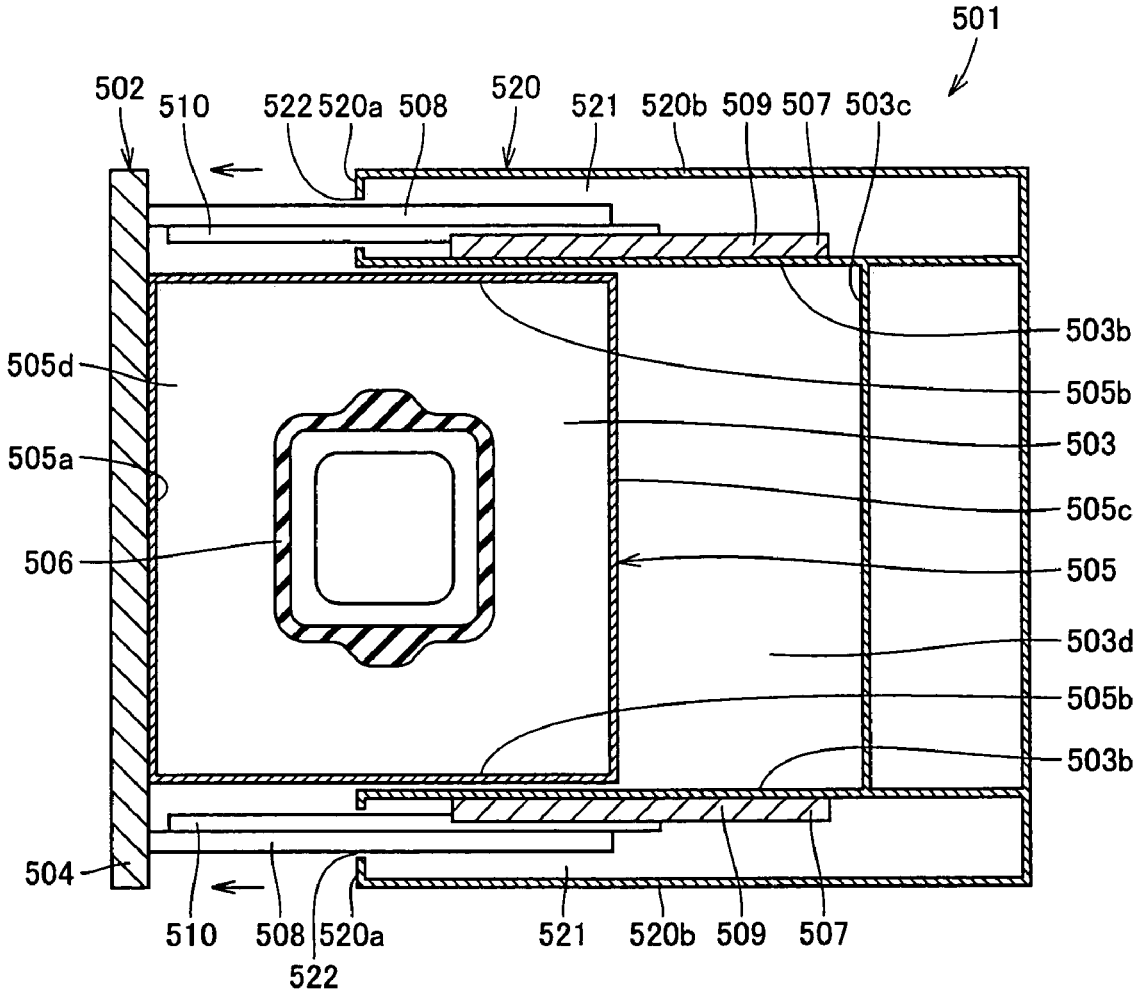
FIG. 16 is a cross-sectional view of the heating and cooking apparatus shown in FIG. 14 viewed from the top.
Figure 17:
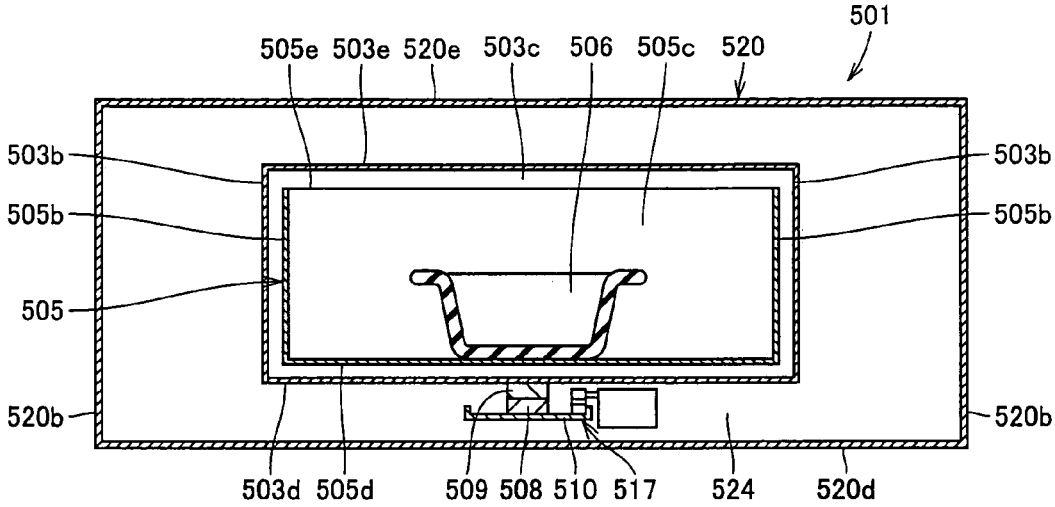
FIG. 17 is a cross-sectional view of the heating and cooking apparatus shown in FIG. 14 viewed from front.
Figure 18:
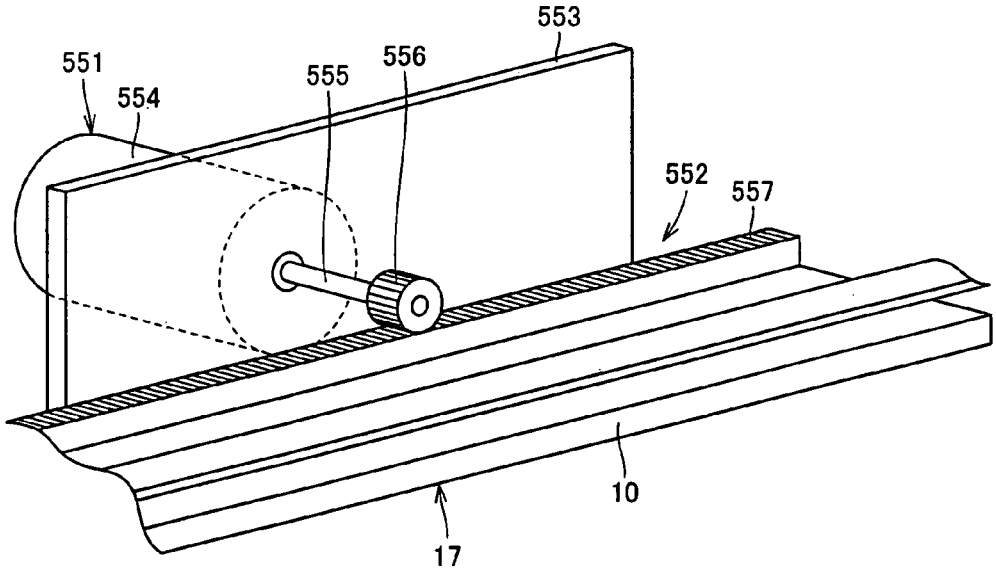
FIG. 18 is a perspective view showing one example of a drive mechanism employed in the heating and cooking apparatus shown in FIG. 14.

In the following, another embodiment of the drawer type heating and cooking apparatus according to the present invention will be described with reference to the drawings. FIG. 14 is a perspective view showing an overall appearance of one embodiment of the drawer type heating and cooking apparatus according to the present invention in a partially cut-away manner. FIG. 15 is a cross-sectional view of the drawer type heating and cooking apparatus shown in FIG. 14 viewed from the side. FIG. 16 is a cross-sectional view of the drawer type heating and cooking apparatus shown in FIG. 14 viewed from the top. FIG. 17 is a cross-sectional view of the drawer type heating and cooking apparatus shown in FIG. 14 viewed from front. FIG. 18 is a perspective view schematically showing a drive mechanism employed in a portion shown with A in the drawer type heating and cooking apparatus shown in FIG. 14. It is noted that FIG. 15 schematically shows a slide mechanism outside a center lower portion and FIG. 17 does not show slide mechanisms on left and right.

As shown in FIGS. 14 to 17, the drawer type heating and cooking apparatus (hereinafter, abbreviated as "heating and cooking apparatus") includes a cooking apparatus main body 501 and a drawer body 502 that can be drawn out of cooking apparatus main body 501. In cooking apparatus main body 501, a heating chamber 503 for cooking a heated target 506 placed in drawer body 502 is formed. Heating chamber 503 has an opening 503*a* in its front face, and it is formed by being enclosed by left and right sidewalls 503*b*, 503*b*, a rear wall 503*c* connecting to sidewalls 503*b*, 503*b* in a rear face (back), a bottom wall 503*d* connecting to sidewalls 503*b*, 503*b* and rear wall 503*c*, and a top wall 503*e*.

Drawer body 502 is arranged to be movable in cooking apparatus main body 501 by means of a slide mechanism which will be described later, such that drawer body 502 can be drawn out in a forward direction from the inside of heating chamber 503 of cooking apparatus main body 501 in a direction shown with an arrow (FIGS. 15 and 16). Drawer body 502 includes a door 504 for opening/closing heating chamber 503 and a heating container 505 having door 504 attached and accommodating heated target 506 in a manner carried therein. Heating container 505 has a front panel 505*a* attached to door 504, side panels 505*b*, 505*b* on left and right sides extending from left and right edges of front panel 505*a* to rearward, a rear panel 505*c* connecting to side panels 505*b*, 505*b* in the rear face (back), and a bottom panel 505*d* connecting to side panels 505*b*, 505*b* and rear panel 505*c*. Heating container 505 has a container opening 505*e* in a top portion, through which heated target 506 can be placed/taken out.

Drawer body 502 is movable between a draw-out position at which heating container 505 is drawn out in a forward direction from heating chamber 503 (corresponding to a drawn-out state in FIG. 14) and a stored position at which heating container 505 is stored in heating chamber 503. In order to move drawer body 502 in heating and cooking apparatus main body 501, the heating and cooking apparatus includes slide rails 507, 507 serving as left and right slide mechanisms arranged outside the left and right sides of heating chamber 503 and a slide rail 517 serving as a central slide mechanism arranged outside the center lower portion of heating chamber 503. When drawer body 502 is located at the stored position, door 504 is located at a position to close opening 503*a* of heating chamber 503. Therefore, an internal space in heating chamber 503 implements a space sealed by inner wall surfaces of cooking apparatus main body 501 and drawer body 502, whereby leakage of microwaves emitted into heating chamber 503 is avoided. When drawer body 502 is located at the draw-out position, heating container 505 is sufficiently drawn out in a forward direction from heating chamber 503, and heated target 506 can be placed in/taken out from heating container 505 through container opening 505*e*.

Each slide rail 507, 517 has a fixed rail 509 attached to cooking apparatus main body 501 and a movable rail 510 that is attached to drawer body 502 and can slide along fixed rail 509. Slide rails 507, 517 may have a structure similar to that of the slide rail for a drawer used in office furniture such as a cabinet and a desk, and detailed description thereof will not be provided. As shown in FIG. 16 or 17, each fixed rail 509 is attached outside sidewalls 503*b*, 503*b* and 503*d* forming heating chamber 503 of cooking apparatus main body 501. In addition, each movable rail 510 is attached to door 504 with an L-shaped angle member 508 attached so as to extend from the inner wall surface of door 504 to cooking apparatus main body 501 being interposed.

In cooking apparatus main body 501, a microwave generator 511 is arranged around heating chamber 503. Microwave generator 511 consists of a magnetron 512 arranged in the rear of heating chamber 503 and generating a microwave and a waveguide 513 arranged at the top of heating chamber 503 and propagating the microwave generated by magnetron 512. The microwave generated by magnetron 512 is propagated through waveguide 513, and emitted through a feeder opening 514 into heating chamber 503.

Each of slide rails 507 on left and right sides is arranged in a manner corresponding to a passage box 521 formed on each of left and right sides of heating chamber 503 in cooking apparatus main body 501. That is, cooking apparatus main body 501 includes as a housing 520, a front wall 520*a* around opening 503*a* of heating chamber 503, left and right sidewalls 520*b*, 520*b*, a rear wall 520*c*, a bottom wall 520*d*, and a top wall 520*e*. In cooking apparatus main body 501, passage box 521 enclosed by sidewalls 520*b*, 520*b* as well as a part of front wall 520*a*, rear wall 520*c*, bottom wall 520*c*, and top wall 520*e* of housing 520 is formed outside sidewall 503*b* of heating chamber 503. Fixed rail 509 for each slide rail 507 is attached outside sidewall 503*b* of heating chamber 503 in passage box 521, and movable rail 510 can freely move into/out of passage box 521 through an insertion hall 522 formed in front wall 520, along with L-shaped angle member 508. Central slide rail 517 is provided in a manner associated with a passage box 524 (FIG. 17) formed outside the center lower portion of heating chamber 503 in cooking apparatus main body 501. That is, passage box 524 is formed between bottom wall 520*d* of housing 520 and bottom wall 503*d* of heating chamber 503 in cooking apparatus main body 501, and slide rail 517 is arranged in passage box 524 along with the drive mechanism which will be described later. As to slide rail 517 as well, movable rail 510 can freely move into/out of passage box 524 through an insertion hall 525 formed in front wall 520*a*, along with L-shaped angle member 508.

As shown in FIGS. 17 and 18, in order to automatically open/close drawer body 502, the drive mechanism for central slide rail 517 is provided. The drive mechanism consists of a drive motor 551 serving as a drive source and a rack and pinion mechanism 552 transmitting rotation output from drive motor 551 to movable rail 510. Drive motor 551 includes a motor main unit 554 attached to a motor attachment angle member 553 fixed to fixed rail 509 and a motor shaft 555 serving as a rotation output shaft extending from motor main unit 554. Rack and pinion mechanism 552 serving as a transmission mechanism consists of pinions 556 attached to a tip end portion of motor shaft 555 and racks 557 engaged with pinions 556. Racks 557 are arranged on movable rail 510 along a direction in which drawer body 502 moves, and correspondingly, motor shaft 555 extends in a direction orthogonal to the direction in which racks 557 extend.

Slide rails 507, 507 and 517 as well as the drive mechanism are provided outside heating chamber 503 such that they can freely move into/out of passage boxes 521, 524 through insertion holes 522, 525. Therefore, slide rails 507, 507 and 517 as well as the drive mechanism are not exposed to a high temperature nor affected by the microwaves emitted into heating chamber 503. Accordingly, as it is not necessary to use an expensive part or a material attaining excellent heat-resistance and flame-retardant property, cost for manufacturing the heating and cooking apparatus can be reduced. In addition, though food placed in heating chamber 503 may leave droppings when the food is placed or taken out or heated, the droppings of the food do not adhere to each of slide rails 507, 507 and 517 as well as to the drive mechanism provided outside heating chamber 503. Therefore, failure of the slide mechanism and the drive mechanism caused by the adhered food droppings can be prevented.

Drawer body 502 is supported in cooking apparatus main body 501 not only by left and right slide rails 507, 507 but also particularly by central slide rail 517. Therefore, drawer body 502 can be drawn out from heating chamber 503 in an extremely stable manner without tilting in a forward-leaning manner.

The moving speed of drawer body 502 driven by the drive mechanism is set to not smaller than 8 cm/s and not larger than 12 cm/s. If the moving speed of drawer body 502 is set to not larger than 8 cm/s, it takes four to five seconds to cover a draw-out length (approximately 36 to 40 cm), and it is known from experience that most users feel uncomfortable for too long waiting time. In addition, even if the heated target is beverage containing liquid, there is no spill when the moving speed of drawer body 502 does not exceed the speed limit of 12 cm/s. On the other hand, if this speed limit is exceeded, there may be spill in heating chamber 503 depending on a shape of a vessel or the like. Spill of the heated target from the vessel is caused by the inertial force corresponding to acceleration of drawer body 502, that is, the vessel carrying the heated target which is the liquid. According to user's feeling, however, drawer body 2 is moved in such a manner that the user feels as if drawer body 2 is substantially instantaneously started and stopped. Therefore, the substantial moving speed of drawer body 502 when it is moved between the stored position and the draw-out position can sufficiently serve as an index for measuring a degree of waving of the heated target, instead of acceleration.

Figure 19A:
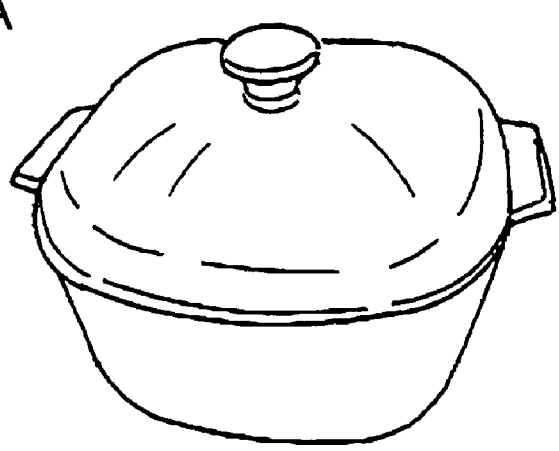
FIGS. 19A to 19C are perspective views showing vessels used for studying a relation between the moving speed of the drawer body and spill of the content.
Figure 19B:
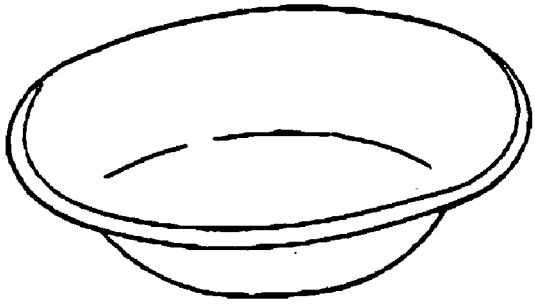
Figure 19C:
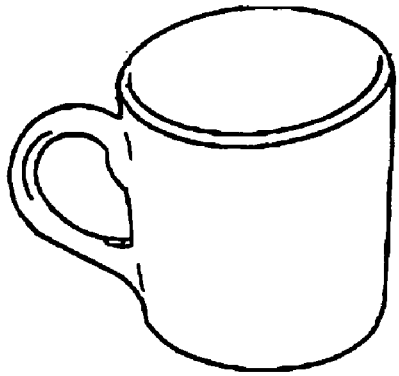

Table 1 shows a relation between the moving speed of drawer body 502 and spill of a liquid content in the vessel. For the vessel, as shown in FIGS. 19A to 19C, a casserole (FIG. 19A) representing a stewing pot made of pottery, a soup bowl (FIG. 19B), and a mug (FIG. 19C) are employed. Whether or not the liquid content is spilt when several moving speeds are set was examined through experiments. A volume in each vessel is as shown in the table, and a contained amount was set to 80% of the volume which is considered as common. Water, which has the lowest viscosity and presents a most strict condition for spill, was selected as a contained material. When the moving speed of drawer body 502 is set to not larger than 12 cm/s, no spill of the food was observed in each vessel. When the moving speed of drawer body 502 is set to 13 cm/s, spill of the content in the casserole and the mug was observed.

It was found that the weight of the vessel does not significantly affect the relation between the moving speed of drawer body 502 and spill of the content. It is assumed that this is because the weight of drawer body 502 is considerably large and difference in the weights of the vessels does not significantly affect the total weight. Therefore, magnitude of a drive current to drive motor 551 does not necessarily have to be varied depending on a type of the vessel or a contained amount. Meanwhile, depending on a desired moving speed of drawer body 502 in a range from not smaller than 8 cm/s to not larger than 12 cm/s, a setting of the magnitude of the drive current to drive motor 551 can be varied in a stepwise manner or continuously. Then, drawer body 502 can be moved at a constant speed in accordance with the set value. In addition, if the heated target is a solid, in which case spill of the content is less likely, drawer body 502 may be moved at a moving speed exceeding the speed limit described above, in accordance with selection by the user. A panel for user setting and manipulation may be provided in cooking apparatus main body 501.

When drawer body 502 is manually moved, the drive mechanism is not required, and drawer body 502 is guided and moved by three slide rails 507, 507 and 517. When drawer body 502 is moved, rack and pinion mechanism 552 and three slide rails 507, 507 and 517 for cooking apparatus main body 501 of drawer body 502 or a guide roller guiding heating container 505 with respect to heating chamber 503 apply a moderate resistance. When drawer body 502 is moved manually with force adequate to overcome the resistance, the moving speed of the drawer body may normally be set to not larger than the speed limit of 12 cm/s.

In the drawer type heating and cooking apparatus according to the present invention, the moving speed of the drawer body is restricted to not larger than 12 cm/s as described above. Accordingly, when a common heated target represented by food placed in a vessel is heated, it has been confirmed that there is no spill of the food in storing and drawing out the drawer body. Therefore, the drawer body can be moved without uncomfortable feeling in the user and without spill of the heated target, and the heated target can be taken out cleanly, that is, in a manner free from spill. In addition, as the heating container is now free from stain due to the spill of the heated target, cleanliness thereof can always be maintained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A microwave heating and cooking apparatus comprising:

a cooking apparatus main body having a heating chamber;

TABLE 1

| Vessel | Volume | Contained amount of water | 8 cm/s | 9 cm/s | 10 cm/s | 11 cm/s | 12 cm/s | 13 cm/s |
|---|---|---|---|---|---|---|---|---|
| Casserole | 3 L | 2.4 L | No spill | No spill | No spill | No spill | No spill | Spilt |
| Mug | 250 $cm^3$ | 200 $cm^3$ | No spill | No spill | No spill | No spill | No spill | Spilt |
| Soup Bowl | 300 $cm^3$ | 240 $cm^3$ | No spill | No spill | No spill | No spill | No spill | No spill |

a drawer body including a base for carrying a heated target and formed such that said base moves from inside of said heating chamber to outside;

drive means for moving said drawer body; and moving speed control means for controlling said drive means in order to vary a moving speed of said drawer body; wherein said moving speed control means controls said drive means such that the moving speed of said drawer body at at least one stage selected from a group consisting of a draw-out initial stage in which said drawer body starts to move from the inside of said heating chamber to the outside, a draw-out final stage in which said drawer body finishes to move from the inside of said heating chamber to the outside, a push-in initial stage in which said drawer body starts to move from the outside of said heating chamber to the inside, and a push-in final stage in which said drawer body finishes to move from the outside of said heating chamber to the inside is relatively slower than the moving speed of said drawer body at an intermediate stage of a draw-out and push-in operation, said drawer body includes a door arranged in a front portion of said heating chamber, said moving speed control means controls said drive means such that the moving speed of said door is gradually increased at the opening initial stage in which said door starts to open and such that said drawer body moves while vibrating, and said drawer body is controllably caused to vibrate during an initial portion of a draw-out operation relative to a remainder of the draw-out operation to avoid user injury due to bumping phenomenon.

2. The microwave heating and cooking apparatus according to claim 1, wherein said drawer body includes a heating container for accommodating the heated target.

3. The microwave heating and cooking apparatus according to claim 1, wherein said moving speed control means controls said drive means so as to gradually increase the moving speed of said door at an opening initial stage in which said door starts to open.

4. The microwave heating and cooking apparatus according to claim 1, wherein said moving speed control means controls said drive means such that said drawer body moves while vibrating by increasing and decreasing the moving speed of said door in a prescribed cycle at the opening initial stage in which said door starts to open.

5. The microwave heating and cooking apparatus according to claim 1, wherein said moving speed control means controls said drive means so as to gradually decrease the moving speed of said door at an opening final stage in which said door finishes to open.

6. The microwave heating and cooking apparatus according to claim 1, wherein said moving speed control means controls said drive means so as to gradually increase the moving speed of said door at a closing initial stage in which said door starts to close.

7. The microwave heating and cooking apparatus according to claim 1, wherein said moving speed control means controls said drive means so as to gradually decrease the moving speed of said door at a closing final stage in which said door finishes to close.

8. The microwave heating and cooking apparatus according to claim 1, wherein said moving speed control means controls said drive means such that the moving speed of said door is maintained substantially constant at an intermediate stage of an opening operation or a closing operation of said door.

9. A drawer type heating and cooking apparatus, comprising:

a cooking apparatus main body in which a heating chamber for heating with a microwave is formed;

a drawer body arranged so as to be movable with respect to said cooking apparatus main body between a stored position at which the drawer body is stored in said heating chamber and a draw-out position at which the drawer body is drawn out of said heating chamber;

a slide mechanism enabling said drawer body to move with respect to said cooking apparatus main body; and a drive mechanism driving said slide mechanism and determining a moving speed of said drawer body in accordance with a magnitude of an output, wherein said drawer body moves at a speed of at most 12 cm/s and attains a moving speed of at least 8 cm/s at an intermediate stage of a draw-out and push-in operation.

10. The drawer type heating and cooking apparatus according to claim 9, wherein said drive mechanism is formed such that said moving speed of said drawer body is variable.

11. The drawer type heating and cooking apparatus according to claim 9, wherein said drive mechanism is formed such that said drawer body substantially instantaneously accelerates to said moving speed or substantially instantaneously stops from said moving speed, at start and stop of said drawer body.

12. The drawer type heating and cooking apparatus according to claim 9, wherein said drawer body includes a door and a heating container attached to said door and accommodating a heated target, and while said drawer body is in said stored position, said door is arranged to close an opening of said heating chamber and said heating container is stored in said heating chamber.

13. The drawer type heating and cooking apparatus according to claim 9, wherein said drive mechanism includes a drive motor attached to said cooking apparatus main body, and a rack and pinion mechanism consisting of a pinion turned by said drive motor and a rack attached to said drawer body and engaged with said pinion.

* * * * *